United States Patent [19]

Johnston

[11] Patent Number: 4,490,711

[45] Date of Patent: Dec. 25, 1984

[54] ELECTRONIC PROGRAMMABLE MULTIPLE ALARM TIMING DEVICE AND RECORD

[76] Inventor: Robert W. Johnston, 754 Southhampton, Palo Alto, Calif. 94303

[21] Appl. No.: 332,573

[22] Filed: Dec. 21, 1981

[51] Int. Cl.[3] ..... G04G 13/02; G04C 23/08

[52] U.S. Cl. ..... 340/309.4; 340/309.5; 368/10; 368/43; 368/246

[58] Field of Search ..... 340/309.4, 309.5; 368/246, 262, 10, 41, 43, 327

[56] References Cited

U.S. PATENT DOCUMENTS

| | | | |
|---|---|---|---|
| 3,818,473 | 6/1974 | Murray et al. | 340/309.4 |
| 4,074,251 | 2/1978 | Creely | 340/309.4 |
| 4,382,688 | 5/1983 | Machamer | 368/10 |

*Primary Examiner*—Glen R. Swann, III

*Attorney, Agent, or Firm*—Alan H. MacPherson; Steven F. Caserza; Richard Franklin

[57] ABSTRACT

Structure ir provided for assisting a person in keeping track of appointments, times for taking medication or the times for turning on electrical equipment or such. The structure comprises an electronic circuit capable of generating signals representing up to N different pre-set times at which specific events are to occur where N is a selected positive integer such as 20. Switches are then provided, each switch corresponding on a one-to-one basis to a unique pre-set time, such that the user can set those switches corresponding to the pre-set times at which the user desires events to take place. An alarm is provided to indicate in sequence when the actual time corresponds to the pre-set time corresponding to each set switch. The user can only shut off the alarm when the alarm is sounding and the system will then automatically record the number of times during which the alarm has come on and the user has responded to the alarm by silencing it thereby to provide a cumulative count of total events to which the user has responded. A doctor can then check the cumulative count to ensure that a patient has presumptively taken medicines prescribed at selected times in accordance with the programmed schedule on the structure. Because the alarm can only be silenced when it is sounding, accidental silencing of the alarm at any time is prevented.

The structure of this invention combines the convenience and ease of an electronic alarm system with the simplicity and permanence of a written record of events.

16 Claims, 52 Drawing Figures

FIG. 3a
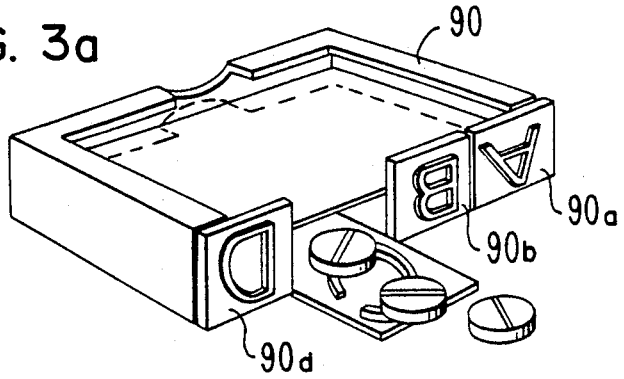
FIG. 3b
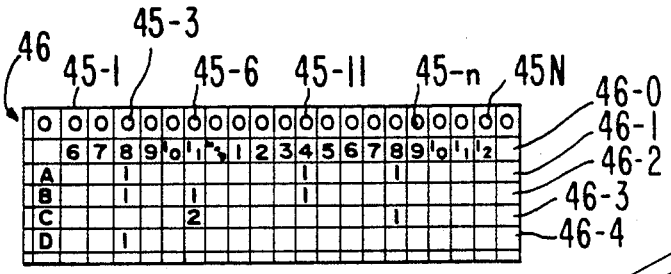
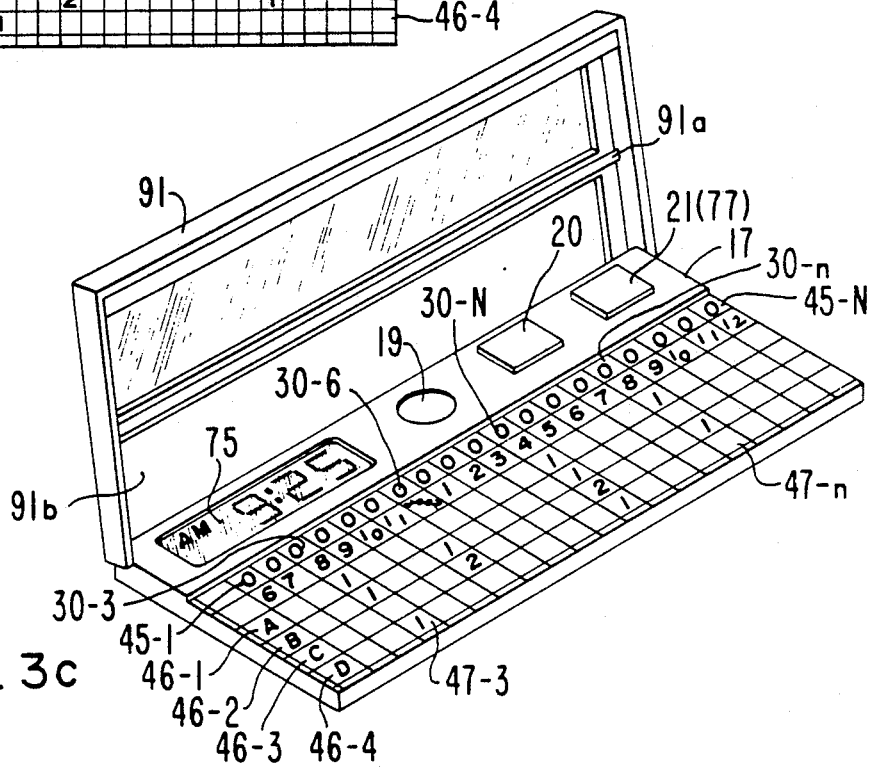
FIG. 3c (SCR OR OTHER SWITCH)

ELECTRONIC PROGRAMMABLE MULTIPLE ALARM TIMING DEVICE AND RECORD

BACKGROUND OF THE INVENTION

1. Field of the Invention

This invention relates to scheduling and in particular to an electronic scheduling structure and method suitable for use in controlling the dispensation of medicine, in keeping track of previously arranged appointments and in controlling the turning on and off of electrical equipment such as appliances and lights.

2. Description of the Prior Art

Various structures and methods are known for reminding a patient when to take a medicine, keeping track of the dispensation of medicines, keeping track of other events in a person's life such as appointments and for turning electrical equipment on and off at preset times. These structures include simple recording systems involving paper and pencil as well as complicated recording systems involving paper, pencil and multiple copies carefully arranged in accordance with desired formats. A medication record keeping package is disclosed, for example, in U.S. Pat. No. 4,295,664.

Electronic reminder systems are also known. Thus U.S. Pat. No. 4,223,801 discloses an automatic periodic drug dispensing system for alerting patients under medication when specific drugs are to be taken. The structure disclosed in the patent includes a timer to indicate when a specific drug is to be taken. The timer can be set to go off at predetermined time interval relative to previously administered drugs. The timer includes a clock, a time totalizer and signal responsive paging device to indicate not only when a particular medicine is to be taken but which medicine is to be taken. The structure disclosed in the patent is a sophisticated, relatively expensive structure and includes an alerting device suitable for automatically sending a signal over the telephone to indicate that a patient needs help. The system provides for the storage and coding of a day's requirements of prescribed drugs and indicates to a patient the specific time and the prescribed drug to be taken.

Electronic diaries and calendars are disclosed in U.S. Pat. Nos. 3,999,050 issued Dec. 21, 1976 and 4,162,610 issued July 31, 1979, as well in U.S. Pat. No. 4,302,752 issued Nov. 24, 1981. Each of these patents describes a system which requires the use of a relatively expensive microprocessor circuit or equivalent. Thus, these structures are relatively expensive and require on-board electronic memory.

Timers having adjustable day and time periods of operation are disclosed, for example, in U.S. Pat. No. 3,834,153 issued Sept. 10, 1974 and in U.S. Pat. No. 4,029,918 issued June 14, 1977. These timers require the use of mechanical and electronic equipment and are not suitable for a portable consumer device due to their large size and power consumption.

Thus, present electronic multiple alarm clocks and message devices often use large microprocessor integrated circuits which are relatively expensive and are difficult for the average consumer to quickly comprehend and remember how to program and interrogate. Both their initial expense and the difficulty in using them makes the microprocessor-based devices less than desirable in many applications. The mechanical/electrical timers, while simpler, are too bulky and require too much power for portable consumer items.

There is a need on numerous occasions for an easily programmable multiple alarm timing device that is compact, portable, inexpensive and which automatically repeats itself every twenty-four hours. It is also important that such a device simultaneously displays current time, alarm set time, and in some applications, what is to occur at the alarm time, as well as provide a record of what is to be done at each alarm time.

SUMMARY OF THE INVENTION

In accordance with this invention, a relatively simple, inexpensive programmable device is provided to allow an individual to determine the time at which medication should be taken or at which the individual has scheduled appointments.

In accordance with one embodiment of the invention described herein, a programmable alarm device is provided to remind people on medication when to take the medication. This device can be easily and accurately programmed for up to a selected number of alarms per day by elderly and incapacitated people who have no computer or electronic watch programming experience. The device is arranged so that it is easy to see at a glance what program schedule has been programmed and what is to occur at the alarm times. As a feature of the invention, in the embodiment used to control dispensing of medication, the device keeps a record of how often the device alarm goes off and is silenced by the user, thus recording how often the user of the device knows it is time to take the medication. This alarm counter provides valuable feedback to the user and the prescribing doctor of how often the user knew to take his medication and presumably did so. The "I forgot" excuse is eliminated.

In accordance with another embodiment of the invention described herein, a pocket memo book is provided that contains a programmable multiple alarm timing device. Using this embodiment, the user is able to set up to a selected number of appointment alarms per day. All the alarm times and instructions for what is to take place at those alarm times can quickly be reviewed at a single glance by the user without pushing any buttons. Each alarm can be easily and self-evidently set in several seconds.

In accordance with another embodiment of the invention, there is provided an inexpensive, simple switch or card programmable multiple time set system with an SCR switch that can be installed in a light switch box or small control box for the purpose of automatically turning lights, electric appliances or control valves on or off at the desired time for security reasons, convenience or control. The program card or switch position informs the user at a glance when the control unit will turn on or off. The present electronic microprocessor-controlled devices used to automatically turn lights, appliances or control valves on and off multiple times per day are relatively expensive, more complex to set and/or do not show at a glance what alarm times are set.

Many present electrochemical timer systems used to automatically turn lights, appliance or control valves on and off multiple times per day are bulky and noisy. Their electronic clocks tend to hum and loud click noises are emitted when their switches are opened or closed. Also, their on and off timers are fairly inaccurate due to the mechanical design of these switches. These switches are driven by high power consumption sixty (60) cycle clock motors and are not suitable for portable consumer devices.

It is, therefore, an object of this invention to provide an automatic multiple alarm system with one or more multiple hour alarms which are very simple to program using a card or a series of on/off switches.

Another object of this invention is to provide a reminder system that is much less expensive than the electronic systems that require electronic memory to remember the alarm-set times.

Another object of this invention is to provide a small and portable reminder system that can comfortably fit into a person's pocket.

Yet another object of this invention is to provide a reminder system that enables a user of the multiple alarms to tell at a single glance the alarm times that are set and what is to occur at the set times.

Another object of this invention is to provide an inexpensive, simple to program, portable automatic multiple alarm system that repeats every twenty-four hours to alert a person on medication when the person should take the medication and which medication to take. In accordance with this invention, the extra medication schedule is easily recognized at a glance on the program card. As a feature of this invention, the electronic unit records each time the person on medication is alerted by the alarm and presses the alarm silence button thus providing feedback to the doctor that the patient knew when to take the medication.

Another object of this invention is to provide an inexpensive simple switch or card programmed portable multiple alarm system that is part of a pocket diary or memo book to alert the user as to his or her preprogrammed appointments. The user, at a glance, can tell which alarm times are set and what is to happen at the alarm times.

Another object of this invention is to provide an inexpensive simple switch or card programmable multiple alarm system that can be installed in a light switch box or control box for the purpose of automatically turning lights, electric appliances, or control valves on or off at the desired times for security reasons, convenience or control.

The system of this invention merges the best features of mechanical record keeping and calendaring systems with the advantages of electronic systems to achieve the flexibility and low cost of the mechanical systems together with the advantages (low power, compactness and automatic reminder) of the electronic systems. In addition, the system of this invention automatically provides a time keeping device of substantial utility, independent of the calendaring, record keeping and alarm functions. There are circumstances in which a calendaring system must produce permanent copies on a daily basis of the appointments of the individual whose time is being calendared. Doctors, lawyers, accountants all require a permanent record of the way they spend their time or of the medicines they prescribe for purposes of professional liability insurance and accounting audits. Accordingly, this invention makes possible the benefits of electronic alarm and time keeping systems together with the advantages of having a permanent record of how time was spent or what medicines were prescribed.

A particular problem with professionals is that when they become engrossed in a particular task, they often lose track of time. This invention reduces or eliminates that possibility.

This invention will be more fully understood in conjunction with the following detailed description taken together with the attached drawings.

DESCRIPTION OF THE DRAWINGS

FIGS. 3*a*, 3*c* and 3*d* illustrate several isometric views of the timekeeping device of this invention used in conjunction with a medicine or pill container and FIG. 3*b* illustrates the record and programming card used in conjunction with the medicine container of FIGS. 3*a* and 3*c* to 3*d;*

FIG. 5*b* illustrates in cross-sectional view the structure shown in top view in FIG. 5*a*; and FIG. 5*c* illustrates in cross-sectional view the structure shown in top view in FIG. 5*a* when switch 18*b* is moved to activate the alarm for the time indicated on the card 4 at the time represented by switch 18*b*.

DETAILED DESCRIPTION OF THE INVENTION

Figure 1:
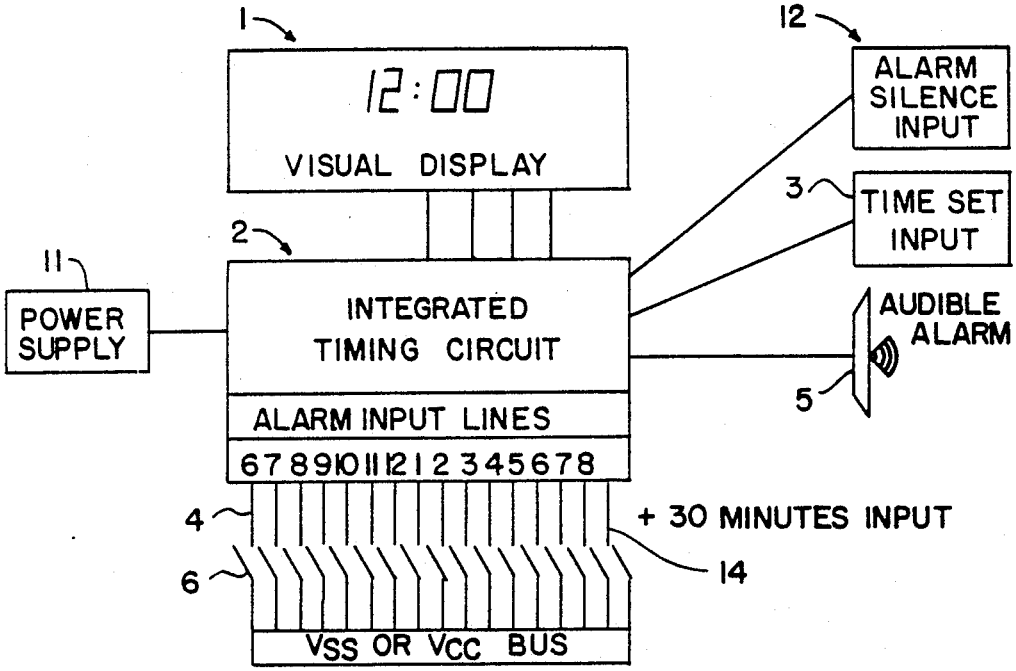
FIG. 1 shows a block diagram showing the system of this invention.

The simplest form of structure in accordance with this invention is shown in FIG. 1. The structure includes an integrated timing circuit 2 which keeps twenty-four hour time. Timing circuit 2 will be described in detail in conjunction with FIGS. 10*a* to 10*fa* but comprises preferably a single integrated circuit chip fabricated using complementary MOS technology for low power consumption. The time is displayed on a low power display 1, which can use LED, LCD or fluorescent elements and is powered either by a miniature battery 11 for portable applications or by stepped down and rectified wall outlet power. The preferred portable power supply is at 1.5 volts although other voltage batteries (such as 3 volts) can be used, if desired. The time is set in conventional electronic watch manner using select and advance buttons on hour and minute time set input 3.

The electronic timing circuit 2 has multiple alarm lines 4 for each potential alarm set time. The electronic timing circuit 2 constantly monitors these input lines to determine which inputs 4 are connected to a power supply VSS or VCC and hence when the alarm 5 should sound. The alarm 5 is a low power piezo electric or miniature coil alarm.

The multiple alarm input lines 4 are normally designed to go off on the hour or half hour. Only 24 input lines are required to set the twenty-four hours from 1 A.M. thru 12 A.M. Another input line 14 (+30 minutes) can be used to shift all the input lines to the half hour. More alarm input lines 4 can be added if desired, but normally about 20 lines are sufficient in the embodiment described herein since the alarm usually does not need to be set to ring in the middle of the night and no input lines are needed for those hours.

Figure 2A:
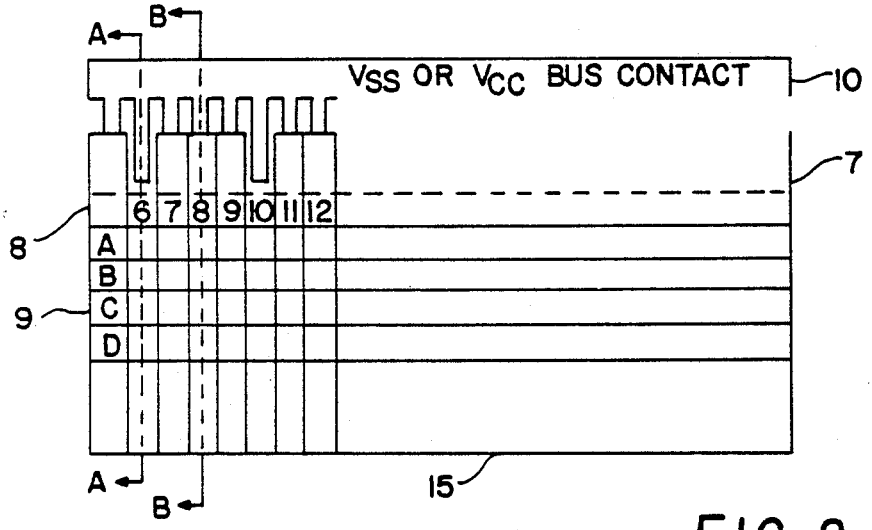
FIG. 2*a* illustrates one simple programming method employed by the structure of this invention.

Several different approaches can be used to program the alarm set timer illustrated schematically in FIG. 1 as switch 6. The preferred approach illustrated in FIG. 2 is to use a cardboard, plastic or other non-conducting material 15 which has partially cut out holes or tabs which can be punched out to program the alarm (FIG. 2 shows the use of tabs.) Programming consists of merely punching out the holes or slots corresponding to the time 8 printed on the card at which the alarm is to go off. Next to each time printed on the card is a space 9 to write what is to occur at that alarm time. Hours 6 through 12 are shown on card 15. As shown in FIGS. 3*b* and 3*c*, rows A through D allow up to four items to be recorded for each alarm time. For example, a check mark or numeral in row A adjacent 8:00 A.M. can indicate that one or more pills of the type stored in compartment A (shown as 90*a* in FIG. 3*a*) are to be taken at 8:00 A.M. The numeral "2" in row C at 11:00 A.M. indicates that two of the pills stored in compartment C are to be taken at 11:00 A.M.

Figure 2B:
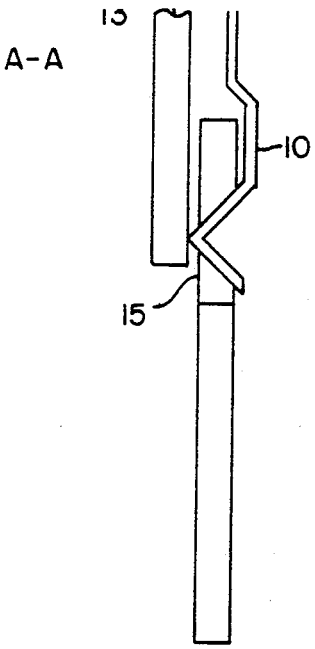
FIG. 2*b* shows in cross-sectional view the relationship between a card on which appointments are written and the structure for transmitting the information on the card to the electronic structure of this invention.
Figure 2C:
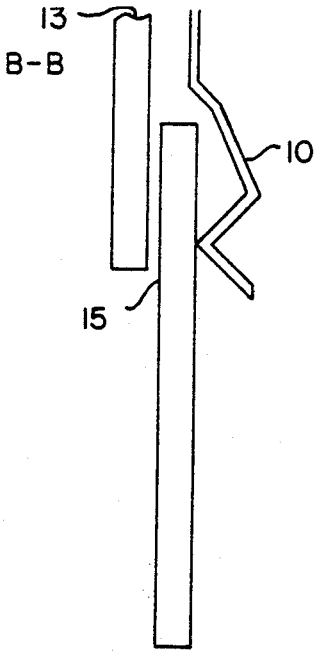
FIG. 2*c* illustrates in cross section the structure shown in FIG. 2*b* at a portion of the card wherein no alarm is to be set off.

The program card 15 of FIG. 2 is shown in FIG. 2*b* inserted between the printed circuit board 13 connected to the alarm inputs and the power supply VSS or VCC 10. In those punched out areas of the card which correspond to the desired alarm set timer, the conductive spring contact 10 carrying VSS or VCC is allowed to contact the desired input lines as in FIG. 2*b* and hence set the alarm. If the area is not punched out as in FIG. 2*c*, conductive spring 10 is not able to contact the underlying input line and no alarm is set for the corresponding time.

The VSS or VCC connection 10 can consist of a common metal strip with spring contact or other resilient common conductor material such as conductive rubber. As a failsafe feature of this invention to prevent undue battery drain, and so that the structure cannot be accidently disarmed before an alarm goes off, if no program card 15 is in place in the device, all alarm input lines will be connected to VSS or VCC 10 and no alarm will be set. At least one alarm line 4 (FIG. 1) must be disconnected before the timer circuit 2 logic will assume a program card 15 is in place and arm the alarms. However, the structure can also be disarmed by inserting an unpunched program card.

Figure 5A:
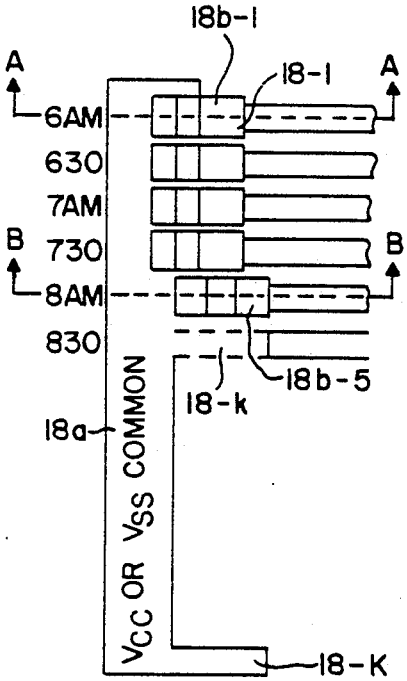
FIGS. 5*a*, 5*b* and 5*c* illustrate the structure of the card of this invention in relation to the switches used by the user to activate an alarm at a selected time in the card.
Figure 5B:
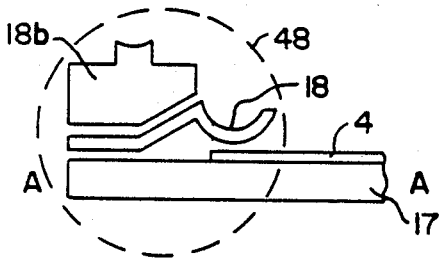
Figure 5C:
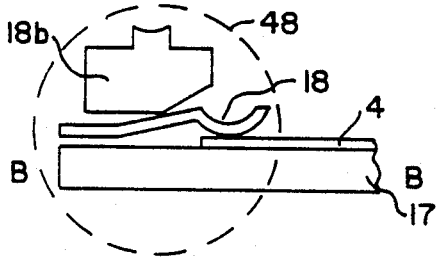

Another embodiment particularly suitable for use as an appointment calendar uses individual switches 6 (FIG. 1) to connect each alarm input line 4 to VSS or VCC. Since one side of the switch 6 (numbered as 48-1 to 48-N in FIG. 4) is shown in FIG. 5*a* as common VSS or VCC line 18*a*, multiple switches 48-1 through 48-K can be inexpensively made as shown in FIG. 5*a* by forming a plurality of comb-like fingers 18-k extending from conductive base 18*a*. When plastic switch handle 18*b* is to the left (FIG. 5*b*), the spring member 18 (connected to a common potential) does not contact the alarm input line 4 on the printed circuit board 17 and the alarm is not set. In FIG. 5*c*, the plastic switch 18*b* is slid to the right and the common spring 18 contacts the alarm input line 4 on the printed circuit board 17 and the alarm is set. The user can easily set alarm times by just pushing the plastic knob 18*b* corresponding to the correct time switch 48 to the right. Alarm set times can be reviewed at a glance by looking at the relative positions of switch knobs 18*b*-1 through 18*b*-K, where K is a positive integer representing the maximum number of switches. A writing surface can be provided to the right of each switch to indicate what is to occur at the time the alarms are set.

Figure 6A:
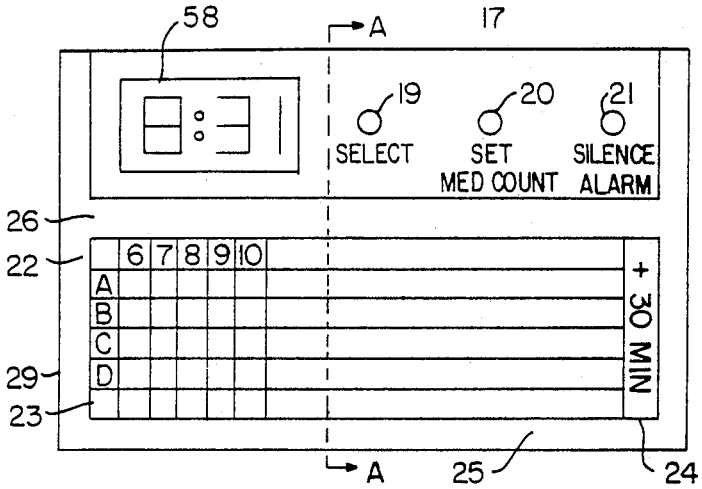
FIG. 6*a* illustrates the structure of this invention when used as a dispenser of pills and other medication.
Figure 6B:
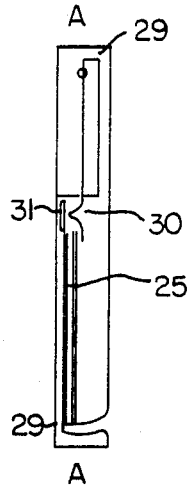
FIG. 6*b* illustrates in side view the structure shown in FIG. 6*a;*

The embodiment of the invention shown in FIG. 6*a* comprises a portable pocket-sized card programmable medical compliance alarm device 17 to alert people on medication when to take medication and what medication to take. The alarm device 17 is first set to the correct time of day by pushing the select button 19 to select hours and minutes. On the display 58 the hour or minutes are then set by pushing the advance button 20 to advance the time to the correct time. Once this is accomplished using circuitry well known in the electronic arts and not part of this invention, all alarm set timers are programmed by the program card 25. The program card 25 (FIG. 6*d*) is merely a thin cardboard or plastic and is disposable. When new alarm times are to be set a new card 25 is used. Card 25 includes a plurality of tabs 32, each partially pre-cut and pre-separated from adjacent tabs.

The alarm times are simply set by tearing off the pre-slit tabs 32 adjacent the desired alarm set times. Below the alarm set time 32 are four rows labelled A, B, C and D which identify which medication is to be taken and how many units. The compartment of the container holding the medication and the quantity is marked on the card in the column under the alarm set time 32.

Figure 6D:
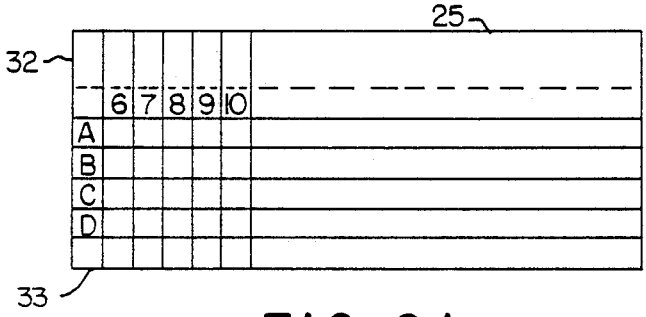
FIG. 6*d* illustrates a record and programming card suitable for use in the structure of FIGS. 6*a* through 6*c*.

The program card 25 is inserted in the medical compliance alarm device 17 by lifting up the transparent front cover 29 (FIG. 6*c*) and placing it over the contacts 30. The transparent front cover 29 is then snapped in place, trapping the program between the alarm input line 30 and common VSS or VCC lines 31, mounted on the inside surface of cover 29.

Figure 6E:
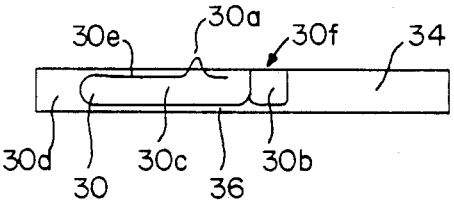
FIG. 6*e* illustrates in cross-section the electrical spring contact 30 used in the structure of FIGS. 6*a* to 6*c*.
Figure 6C:
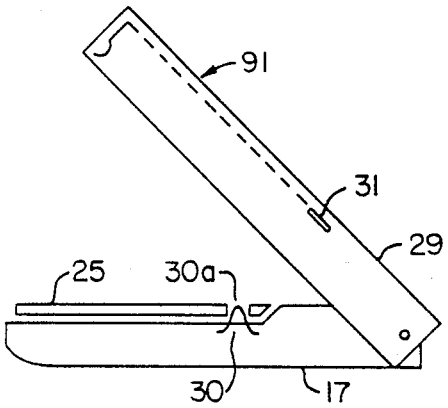
FIG. 6*c* illustrates an end view of this structure with the lid open for receipt of a new card.

Conductive contact 30 comprises a conductive spring metal having a protruding bend 30*a* designed to insert through a hole in the paper record 25 to be inserted into the timer. Spring metal 30 is configured such that one end 30*b* (FIG. 6*e*) is approximately U-shaped and can be soldered at 30*f* into a printed circuit board 34 containing the circuitry of this invention. Preferably circuit board 34 is patterned only on one side with a conductive lead pattern for low cost but can, if desired, be patterned on both sides. An extension 30*c* of spring 30 from U-shaped section 30*b* rests on a support surface 36 such that section 30c and 30b cannot flex and fatigue relative to each other. A round bend 30d then joins section 30e of spring 30 to section 30c. Section 30e contains on one end contact protrusion 30a of the spring 30. The advantage of the structure shown in cross section in FIG. 6e is that contact spring 30a has a long bending arm so as to minimize the forces and stresses required to bend spring 30 while at the same time not stressing spring 30 beyond its fatigue limit.

The alarm will go off at the preprogrammed times. The alarm is silenced by pushing the silence alarm button 21 (FIG. 6a) through an opening such as 91b in FIG. 3c in transparent cover 91. At the same time as the alarm is silenced, a counter is incremented inside the integrated timing circuit. The counter indicates how many times the user has been alerted that it was time to take medication and in response thereto turns off the alarm. This records the user's faithfulness in following his or her medication schedule. It also enables the doctor to see how well the patient is following the medication schedule. The counter can be viewed by holding down button 20 for several seconds and the count will then appear on the LCD display 58. It can be zeroed out by holding down button 20 and pushing button 19, all in a manner well known in the electronics art.

Figure 3D:
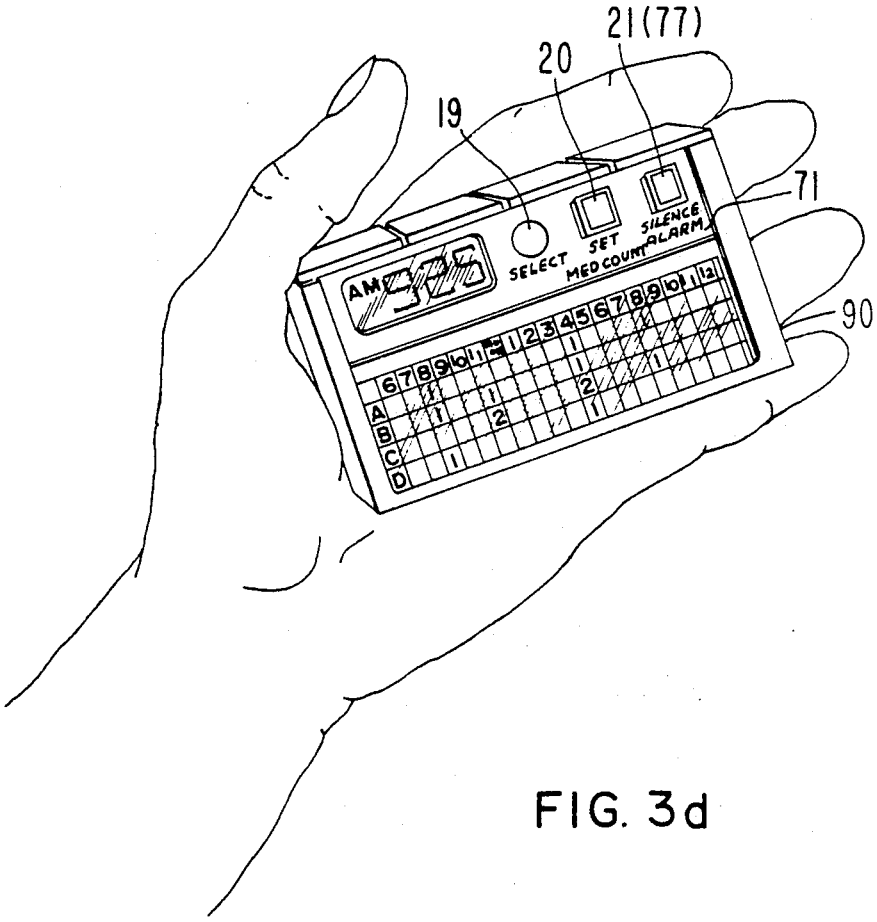

The medical compliance alarm device 17 is shown in FIG. 3d inserted in a pill dispense box 90 shown in detail in FIG. 3a. The alarm slides into a frame in the form of the pill dispenser box. The box 90 has four compartments labelled A, B, C and D to correspond to the hour medications noted on the program card 25 (FIGS. 6a and 6d). The lids of the pill dispensing box 90 are integrally hinged. Spaces are provided on the back of the pill box 90 to further identify what medication is in each compartment. The user can place, for example, one day's or more supply depending upon medication schedule, in each compartment. The alarm device 17 can be easily removed from the pill container 90 and the container 90 can then be washed.

Figure 4:
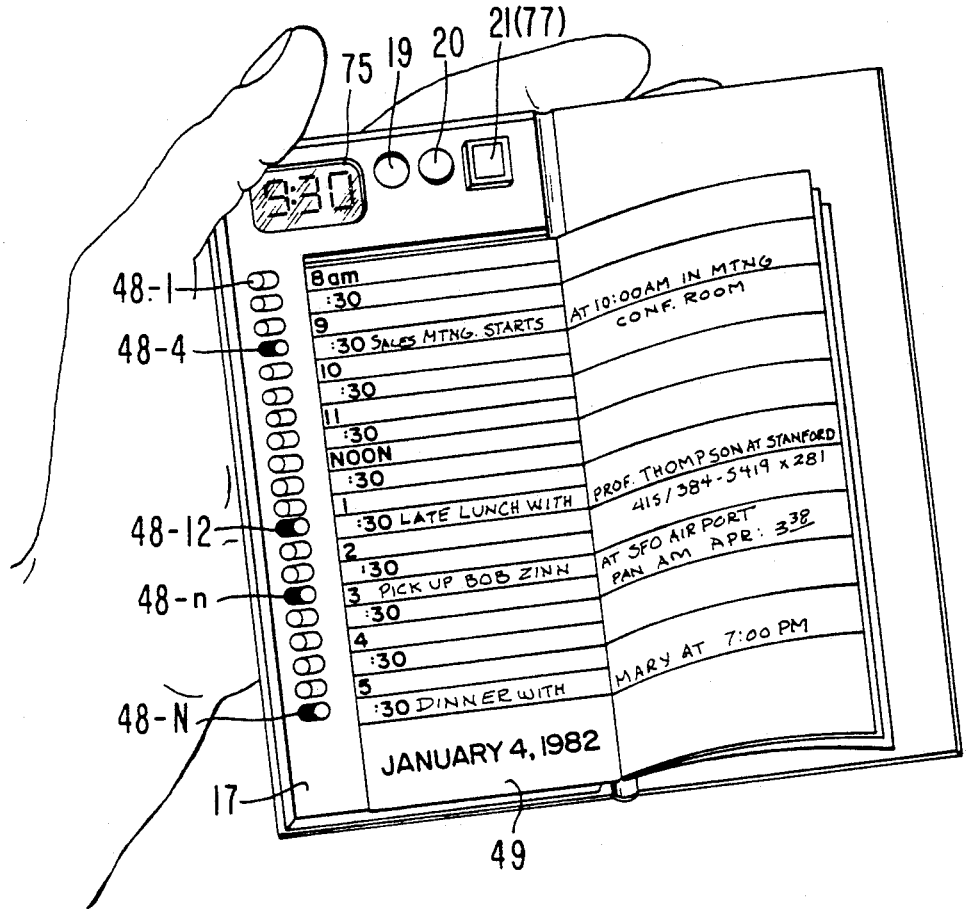
FIG. 4 illustrates the structure of this invention configured to be used in conjunction with a calendar or appointment book.

Another embodiment of the invention shown in FIG. 4 is a pocket memo book that contains the programmable multiple alarm timing device 17 with 20 alarm set times on the hour and half hour from 8 A.M. to 5:30 P.M. These alarm times can be increased (or decreased) to any desired number by adding (deleting) alarm input lines.

After setting the clock to the correct time as described above, the programming of the selected alarm set times is easily done simply by flicking switch 48-n as described above in conjunction with FIGS. 5a through 5c. The user can write on the memo pad 49 directly adjacent the turned-on switch what is to occur at the set alarm time. This system provides a very simple, fast method to set up to 20 or more appointment times per day and to be able to see at a glance what alarms have been set and what is to happen. To accomplish this with a microprocessor system using electronic memory would take more time to program and review, would be substantially more expensive and would not continuously display and record the event to occur at that time. In addition, a major disadvantage of microprocessor systems is that they do not provide a hard copy.

Figure 8:
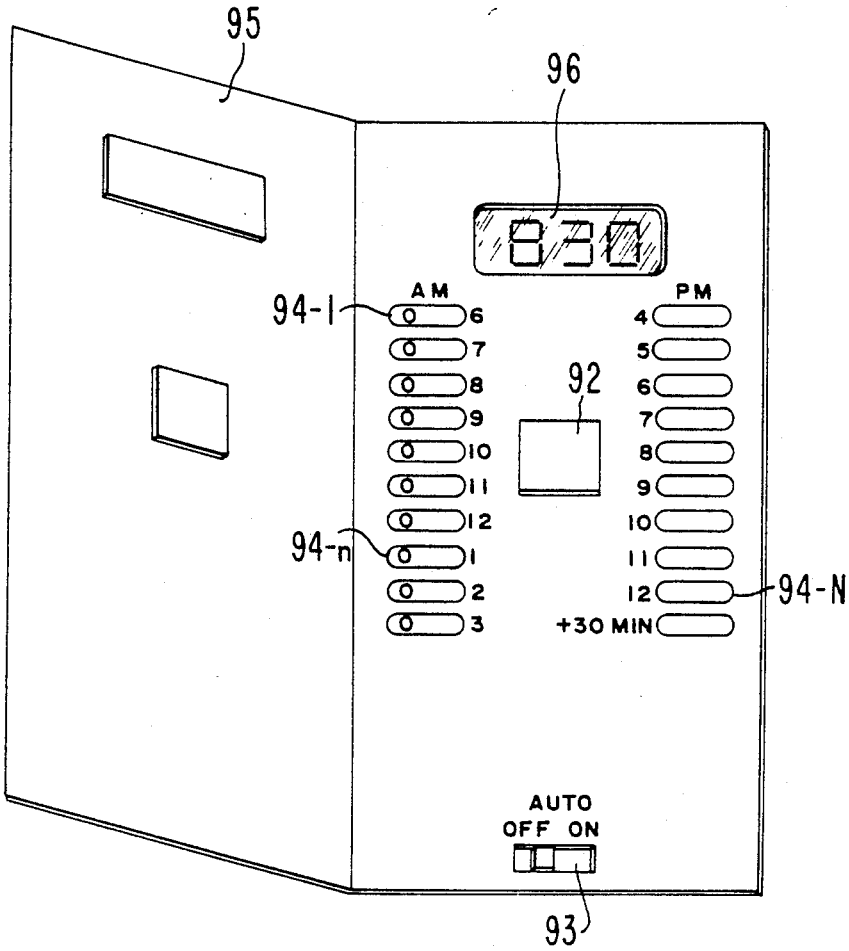
FIG. 8 illustrates structure of this invention when used as a control system for turning on or off lights or other objects in a house.

The embodiment of the invention shown in FIG. 8 is an inexpensive switch programmable multiple turn on, turn off system that can be installed as a light switch box to automatically turn the lights on and off at desired times for convenience, security or energy savings reasons. This embodiment contains the same electronic circuitry, display and switches shown in the FIG. 4 embodiment. However, it is powered by the house power and has a push button on/off switch 92 which overrides the automatic system. Additional switch 93 enables the automatic system to be in control. "On" times are programmed by sliding the desired alarm switch 94-n to the right at the desired "on" time (where n is an integer given by $1 \leqq n \leqq N$). The next set alarm time will turn the unit off. The light will come on at the programmed "on" time and will stay on until the next set "on" time signals the unit to turn "off". If switch set times were a given preprogrammed time period, the light would stay on for that time period. Naturally, this set time can be set as desired by changing components.

Figure 9:
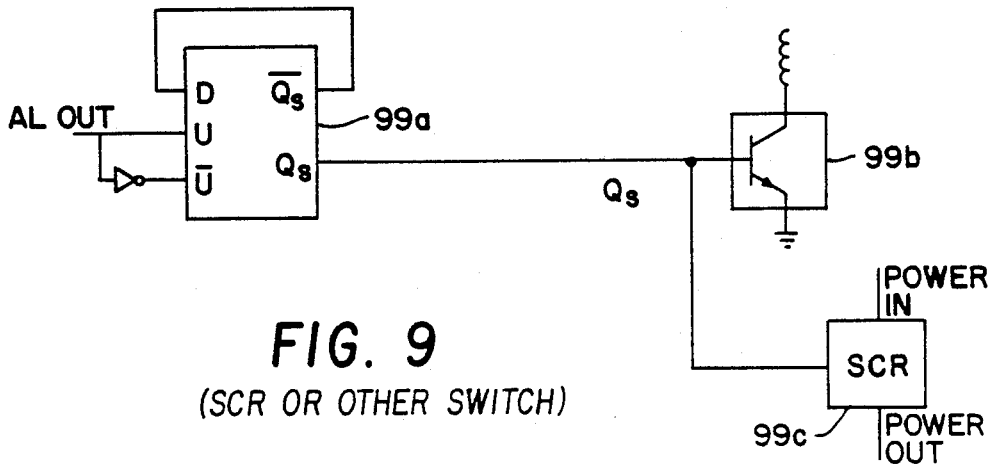
FIG. 9 illustrates a switch for use in the structure of FIG. 8.

When the door 95 is snapped shut only the time display 96 and the on/off switch 92 are exposed to the room leaving a clean uncluttered appearance. As shown in FIG. 9, the switching of the load can be performed by an integral SCR switch which is controlled to toggle on and off by the programmable system in a manner well known in the electronic arts. However, it is preferred to use a flip-flop (such as a "D" flip-flop 99a) in conjunction with an SCR or a relay switch such as switch 99b, depending on the current load being switched.

Figure 7:
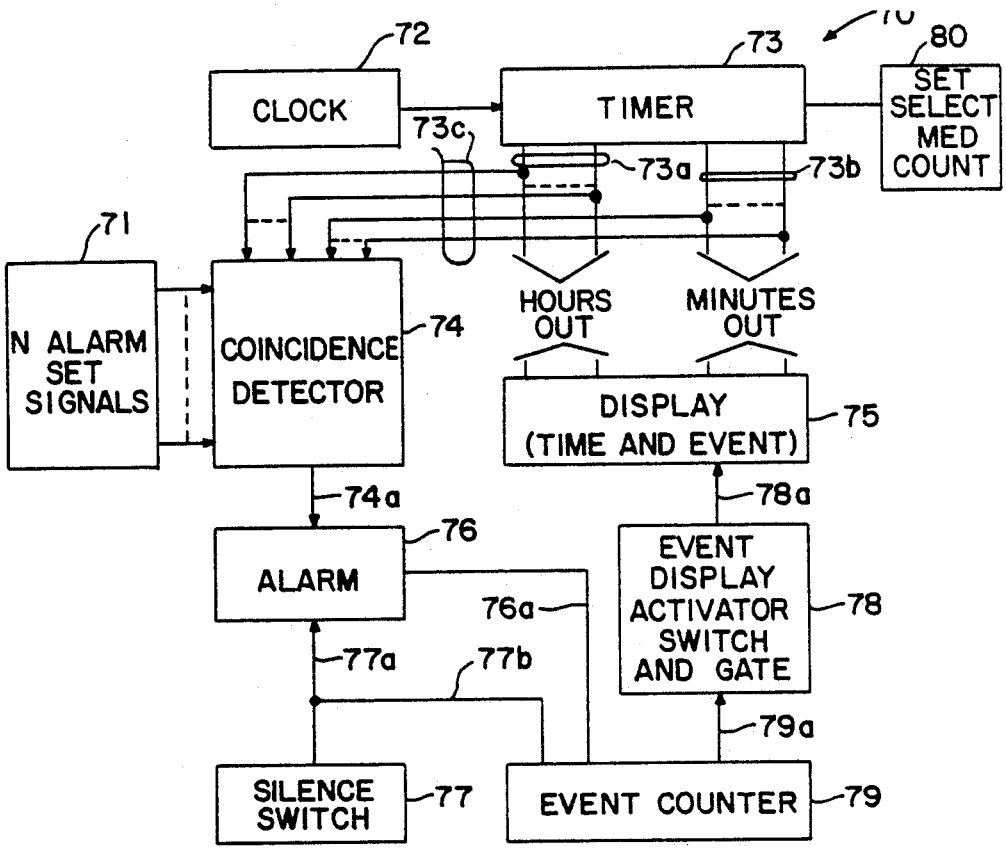
FIG. 7 illustrates in schematic block diagram form the circuitry used to control the disclosed structure.

FIG. 7 illustrates in schematic block diagram form the circuitry 70 comprising the controls, displays, detectors and other logic required to implement this invention. Each of the block diagrams illustrated in FIG. 7 comprises structure well known in the arts. The basic structure comprises a clock 72 which provides clocking signals to timing circuitry 73. Timer 73, as will be shown shortly, comprises a series of flip-flops interconnected in a well-known manner to provide output signals representative of the minutes and the hours of the day. Clock 72 comprises a quartz crystal oscillating at 32,768 cycles divided down to provide output signals to the timer 73 representative of each second of time.

The output signals from timer 73 comprise hours and minutes and are transmitted to display 75 on lead 73a and 73b. These output signals are also transmitted on lead 73c to coincidence detector 74. Coincidence detector 74 is set to provide an output signal on lead 74a to activate alarm 76 whenever the time produced by timer 73 corresponds to the pre-set times selected by the N alarm set signals 71. The "N" alarm set signals 71 comprise merely switches (such as shown in openings 45-1 through 45-N (FIGS. 3b, 3c) in the simplest embodiment sufficient to activate or deactivate the coincidence detector which has been prewired to indicate the occurrence of each of the N selected times. As described above, these coincidence detectors are wired to provide hourly increments when the alarm times are to be used for taking medicine or half-hourly increments when the alarm times are to be used for business appointment schedules.

The output signal from coincidence detector 74 indicating the occurrence of a pre-set alarm time is transmitted to alarm 76. Alarm 76 can be audible, visible or both, but preferably is audible. The output signal from alarm 76 is turned off by the user pressing silence switch 77 of well-known design. The signal from switch 77 is transmitted to alarm 76 on lead 77a and is transmitted to event counter 79 on lead 77b. The coincidence of a signal from silence switch 77 together with a signal from alarm 76 transmitted on lead 76a to output counter 79 indicates that an event has occurred. When the system is used for medication, event counter 79 indicates that the user has been warned that it is time to take medicine and has pressed the silence switch 77 presumably in response to the alarm. The assumption is then made that the user has taken the required medicine and output counter 79 automatically records another event. Event activator 78 transmits the cumulative count in counter 79 on leads 79*a* and 78*a* to display 75 so as to display the total number of times the user has taken medicine in response to a warning from the system.

Portions of the electronic circuitry contained within the integrated circuit chip controlling the operation of the timer and structure of this invention are shown in FIGS. 10*a* through 10*fa*. In one embodiment of this invention, the structure is fabricated to provide alarms every hour on the hour for twenty hours throughout the day from 6 a.m. through 12 a.m. Each time is prewired within the structure and can be set by programming the program card 46 as described above and shown in FIG. 3*b*. The structure is premised upon the fact that medication is usually not taken between the hours of 12 a.m. and 6 a.m. when a patient is sleeping. If desired, the hourly alarms can be shifted by thirty minutes to provide half-hour alarms. Alternatively, the same structure is appropriate for use as a calendar and date book by allowing this system to be operated to indicate times from 8 a.m. to 5:30 p.m. on half-hour increments. The structure is quite simple and to maintain simplicity, the system, when used as a medical dispenser, can only operate on the hour or the half-hour, but not on both the hour and the half-hour.

Figure 10A:
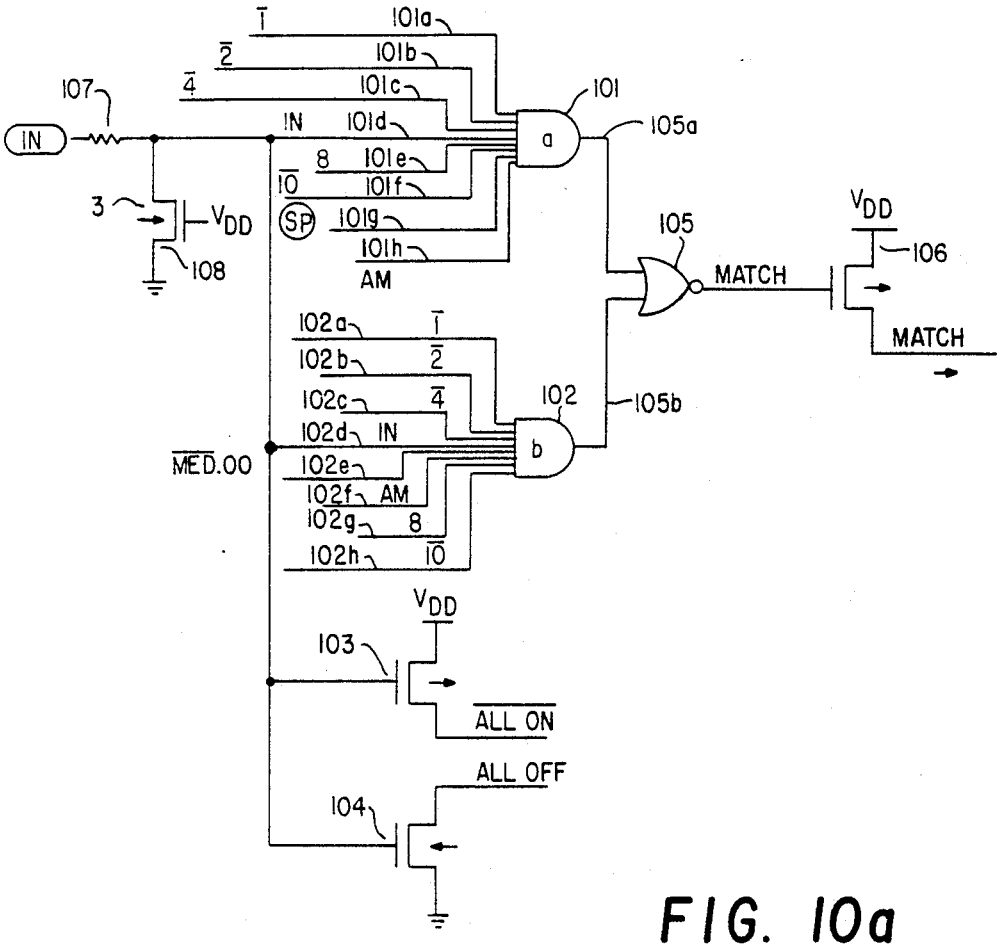
FIGS. 10*a* through 10*fa* illustrate the electronic circuitry used to implement the alarm and timing functions of this invention.
Figure 10B:
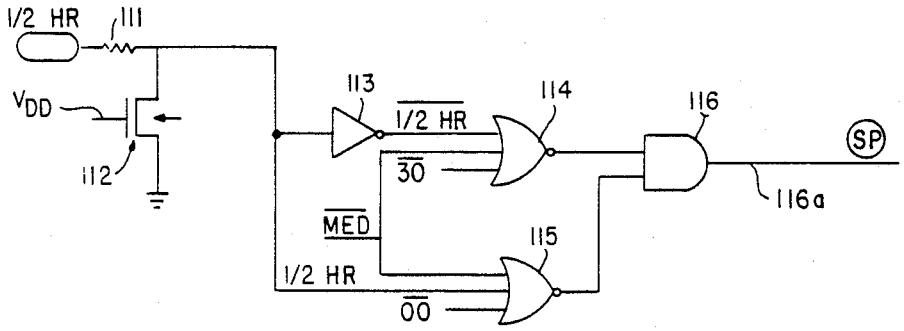

FIG. 10*a* illustrates the input cell (of which there are 19) to receive a signal indicating that a given time has been set for an alarm and to compare the alarm signal to signals representing the actual time. Thus, AND gate 101 has a plurality of input leads 101*a* through 101*h*. Leads 101*a* through 101*c* carry signals at a high level when the $\overline{1}$, $\overline{2}$, $\overline{4}$ signals from the hour counter 330 shown in FIG. 10*p* are high level. The hour counter 330 shown in FIG. 10*p* produces output signals corresponding to the hours on the output leads of amplifiers 332*a* through 332*e*. Thus, if the time is 8 a.m., the output signal from amplifiers 332*a* through 332*e* are all low level except for the output signal from amplifier 332*d* which is high level. Accordingly, the input lead 101*e* to AND gate 101 connected to the output lead from amplifier 332*d* carries a high level input signal while the input leads 101*a*, 101*b*, 101*c* and 101*f* corresponding to the $\overline{1}$, $\overline{2}$, $\overline{4}$ and $\overline{10}$ input leads also carry high level signals. If the time is a.m., the output signal from flip-flop 344 will be such that the $\overline{\text{p.m.}}$ signal is high level indicating A.M. The lead carrying the $\overline{\text{p.m.}}$ signal from flip-flop 344 is connected to lead 101*h* to AND gate 101 and this lead too will carry a high level signal. If the 8 a.m. switch, (described above in conjunction with FIGS. 5*a* through 5*c*) has been turned on, then the input signal on lead 101*d* will also be high level. Accordingly, when 8 a.m. occurs, the signal on input lead 101*e* on AND gate 101 will go high level, therefore producing a high level output signal from AND gate 101 on lead 105*a*. NOR gate 105, which normally produces a high level output signal will therefore produce a low level signal indicating a match, thereby producing a high level output signal on the match output lead from gate 106 (a P channel device is indicated by the arrow pointing away from the gate). The match output signal from gate 106 is then transmitted to the "D" input lead of flip-flop 138 (FIG. 10*d*). If the alarm-on signal is active (and this signal is active only if at least one tab has been removed from the card 25 inserted into the structure as described above in conjunction with the description of FIGS. 5*a* through 5*c* and furthermore only if at least one tab is left unremoved from the card 25), then the $\overline{\text{ALLON}}$ signal is high and the ALLOFF signal is low. The result is that the output signal from NOR gate 134 goes high, thereby driving the output signal from NAND gate 135 to a low level and thereby enabling flip-flop 139. The output signal from flip-flop 139 $\overline{\text{ALMOUT}}$ drives flip-flop 140 to produce ALM1 and $\overline{\text{ALM1}}$ signals which are transmitted of input leads to AND gates 141 and 142 (FIG. 10*e*) of the alarm driving circuit (FIG. 10*e*). After one minute, a signal RSEC is derived from the "second" counting circuit (FIG. 10*r*) and transmitted to flip-flop 140, thereby resetting flip-flop 140 and switching the state of the output signals from flip-flop 140 such that ALM1 goes low and $\overline{\text{ALM1}}$ goes high. Consequently, AND gate 141 which was enabling the alarm circuit with two cycle per second pulses every two seconds (the BRES.X4) signal is a high frequency signal at about 2,000 cycles per second which comprises the alarm drive frequency) no longer passes the alarm drive frequency. Rather signal $\overline{\text{X4}}$ is applied to another input lead of AND gate 142 which is activated to produce an alarm output signal every 18 seconds for one second to provide two one-quarter second beeps from the audible alarm driven at 2,000 cycles per second by the $\overline{\text{X4}}$ signal. The "alarm out" pad is connected to a coil and an alarm transistor which drives a piezo electric alarm. At the end of 10 minutes, the minute count circuit shown in FIG. 10*b* produces the signal RM1 which goes high level 10 minutes after the hour. This signal is transmitted to one input lead of NAND gate 135 there to shut off the alarm by producing a high level output signal from NAND gate 135 to disable flip-flop 139.

Flip-flops 138, 139 and 140 are driven by the MATCH from FIG. 10*a*. $\overline{\text{X6}}$ is a 512 hertz signal which is used to avoid race conditions in the circuit.

When the card 46 (FIG. 3*b*) or 25 (FIG. 6*d*) is not in proper position, or has all its tabs removed or holes punched, then the ALLON signal or the ALLOFF signal (FIGS. 10*a* and 10*d*) prevent the alarm from working.

The minute counters of this timer are also shown in FIG. 10*p* and comprise flip-flops 302*a* through 302*g*. These flip-flops are driven by a clock signal CLMIN derived from the seconds counter (FIG. 10*r*). Minute counters 302*a* through 302*d* are reset after ten (10) minutes by signals $\overline{\text{MIN8}}$ and $\overline{\text{MIN2}}$ applied to OR gate 305. Counters 302*e*, 302*f* and 302*g* (FIG. 10*p*) count in increments of ten minutes and are reset every sixty minutes by the $\overline{\text{MIN40}}$ and $\overline{\text{MIN20}}$ signals applied to NOR gate 309.

The seconds counters shown in FIG. 10*r* comprise flip-flops 322*a* through 322*f* which are reset after sixty (60) seconds by a signal from OR gate 323 driven by the $\overline{\text{S32}}$, $\overline{\text{S16}}$, $\overline{\text{S8}}$ and $\overline{\text{S4}}$ signals.

Figure 10C:
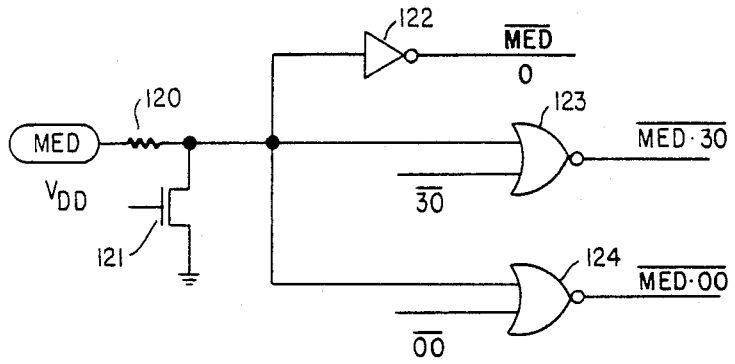
Figure 10D:
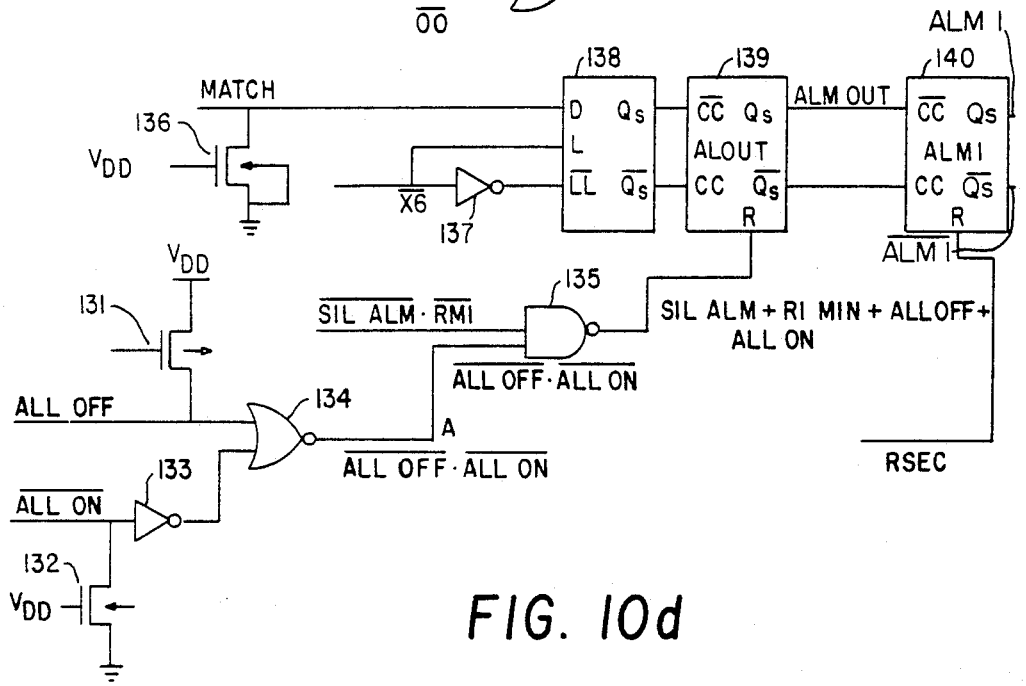
Figure 10E:
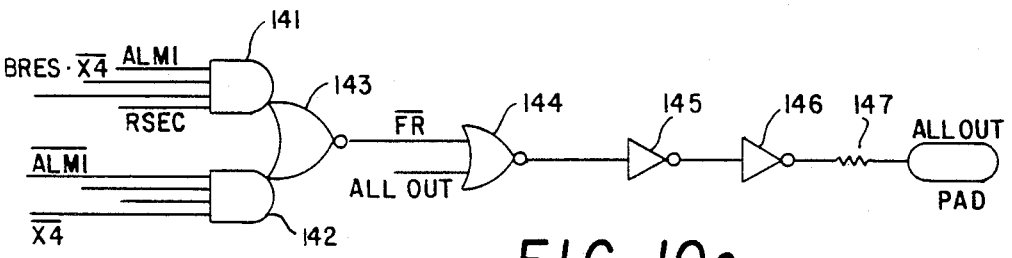
Figure 10F:
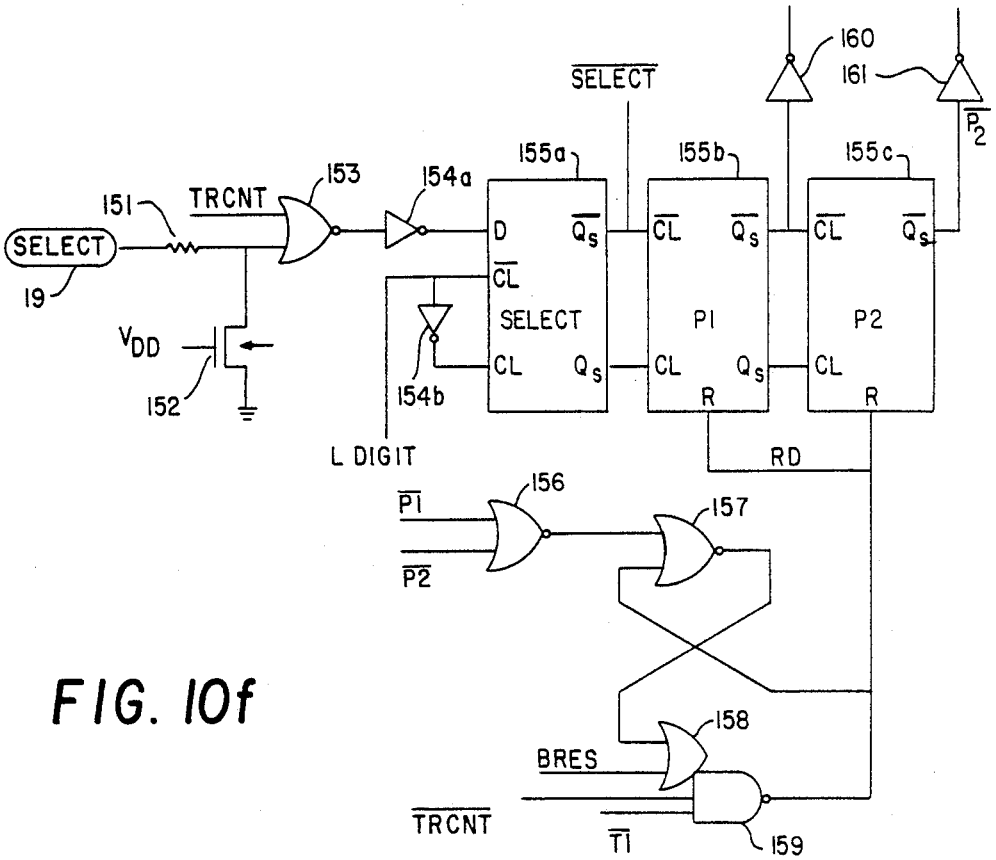
Figure 10G:
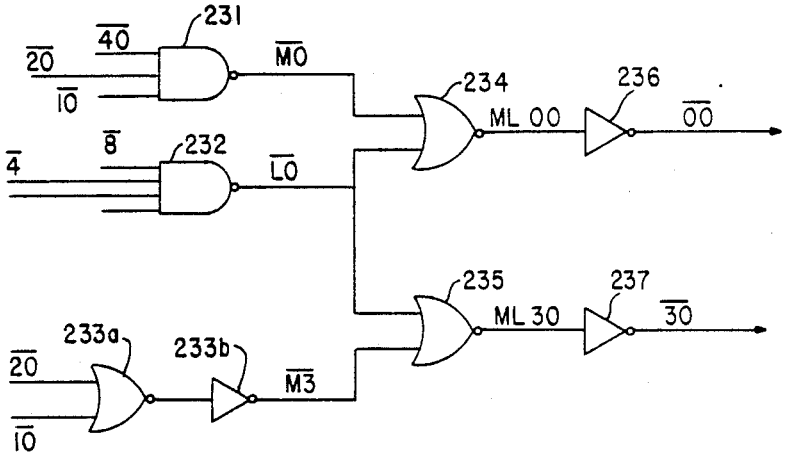
Figure 10H:
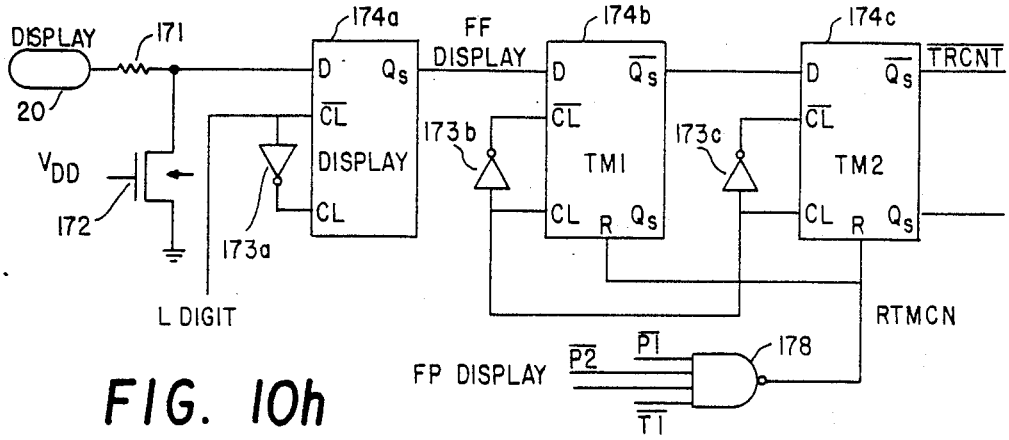

FIG. 10*c* shows the circuit which controls whether or not the structure operates in the medical mode or in the non-medical mode. By bonding the MED pad to the supply voltage the circuit is switched from medical to non-medical use by generating a high level output signal $\overline{\text{MED.00}}$ or $\overline{\text{MED.30}}$ every thirty minutes on the output leads from NOR gates 123 or 124. This high level output signal is then transmitted to the similarly labelled input lead on the appropriate input cell (such as cell 102 in FIG. 10*a*, for example) to enable AND gate 102. AND gate 101 and the other eighteen AND gates, each set to provide a high level output signal at a corresponding hour when the circuit is used in the medical mode, are disabled by the $\overline{MED}$ signal transmitted from inverter 122 (FIG. 10*c*) to the input leads of OR gates 114 and 115 (FIG. 10*b*) thereby producting $\overline{SP}$. $\overline{SP}$ disables AND gate 101

Figure 10I:
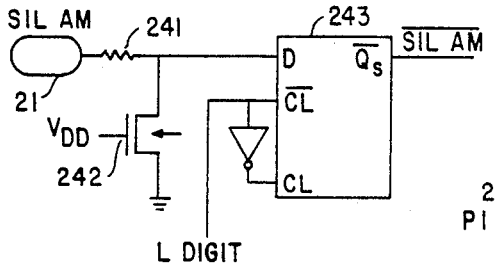
Figure 10J:
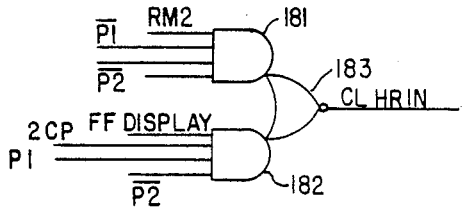
Figure 10K:
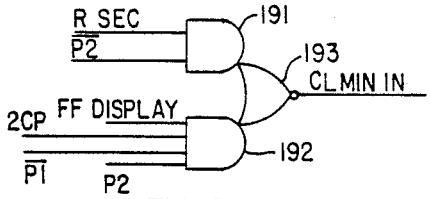
Figure 10L:
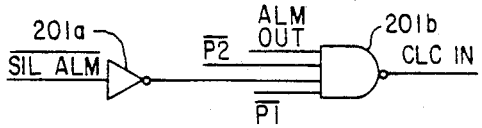
Figure 10M:
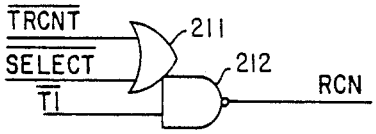
Figure 10N:
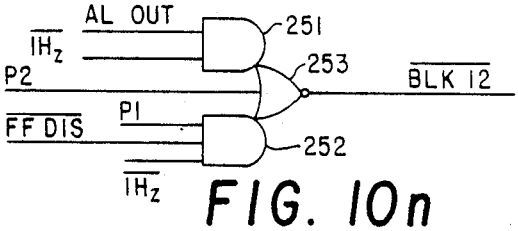
Figure 10O:
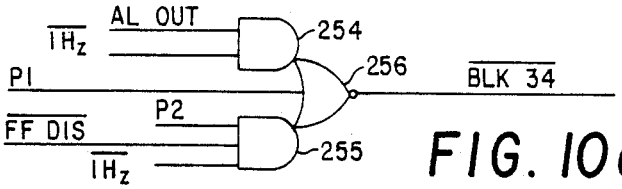
Figure 10P:
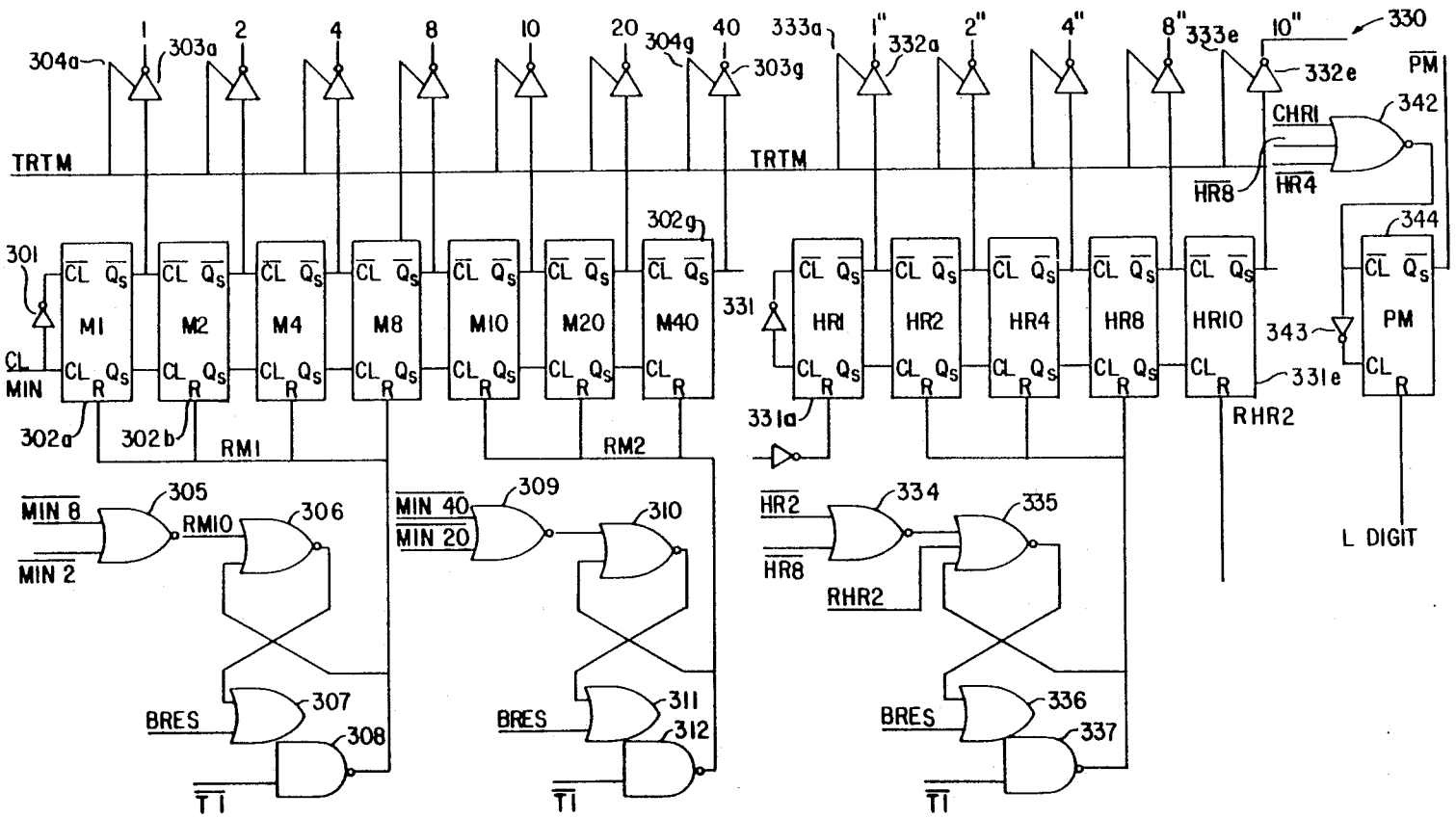
Figure 10Q:
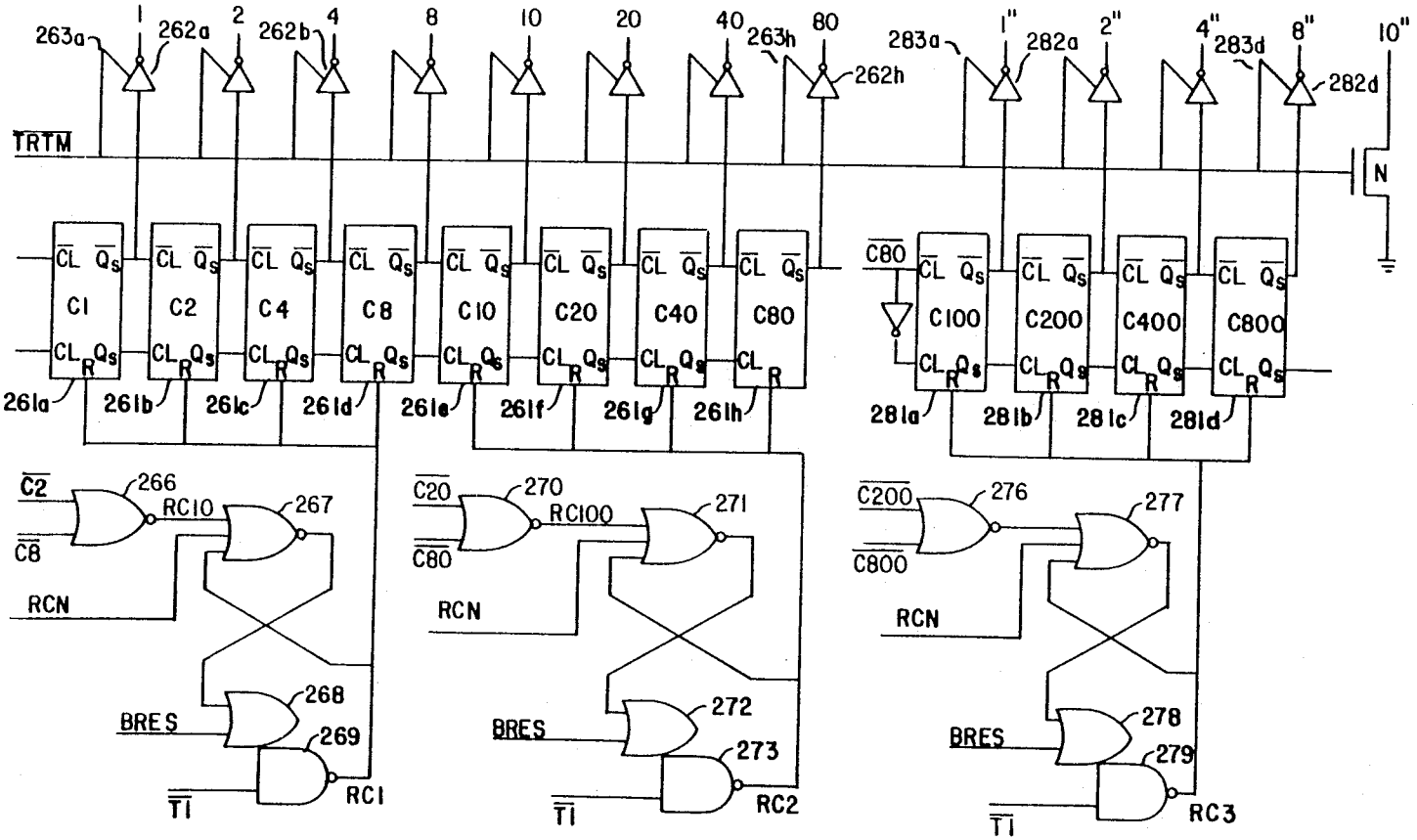
Figure 10S:
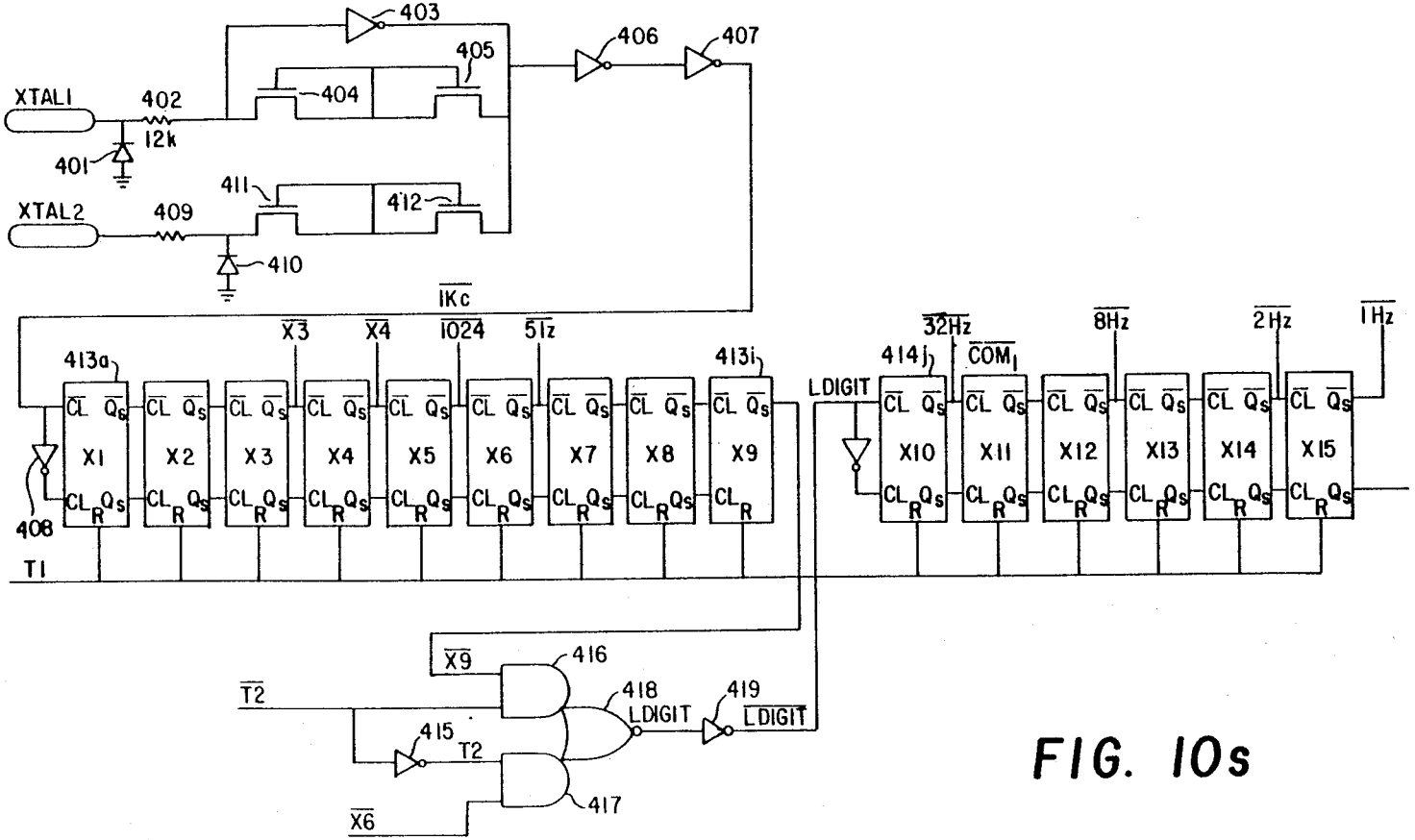
Figure 10R:
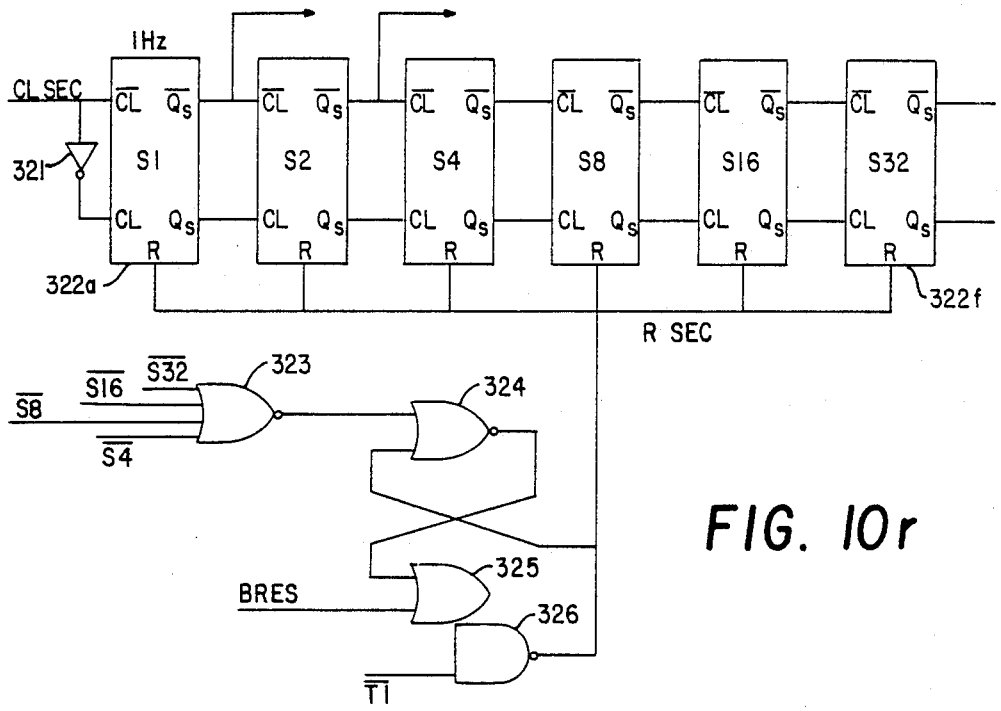

The event counter of this invention is shown in FIG. 10*q*. This event counter is capable of counting up to 999 events and comprises flip-flops 261*a* through 261*h* and 281*a* through 281*d*. These flip-flips are configured as shown to store up to 999 events and automatically reset to zero although the circuit can be configured by circuitry known in the art to reset to zero whenever the commulative count reaches another pre-selected number. The event counter is triggered by an input signal on the CL and $\overline{CL}$ input leads to flip-flop 261*a* derived from a switch controlled to operate only when the alarm turns on and the ALARM SILENCE switch has been pressed (see FIG. 10*l*). The alarm silence switch can be activated either by the user pressing switch 21 (also sometimes denoted as 77) (see FIGS. 3*c*, 3*d*, and 10*i*, for example) or by the opening of the lid 91 of container 90, in which event the switch 77 is configured to be automatically activated by the opening of lid 91. The flip-flops 261*a* through 216*d* are reset every ten events by signals coming into NOR gate 266 on input lead $\overline{C2}$ and $\overline{C8}$, or by an input signal RCN to NOR gate 267 (i.e. reset counter obtained by hitting first the set or display switch 20 and then hitting select switch 19). Input signals BRES to NOR gate 268 and $\overline{T1}$ to NAND gate 269 can be used to test the counter.

If desired, the event counter 79 (FIG. 7) shown in FIG. 10*q* can automatically be reset to zero at 12:01 a.m. or some other selected time each day by connecting the minute and hour counters through appropriate gates to provide a reset signal to reset each of flip-flops 261*a*–261*h* and 281*a*–281*d*. This allows the event counter to be used as a medical compliance device wherein the patient or doctor can determine each day how many times the patient has been warned by the alarm system and responded to the alarm system to take medication. In the alternative mode, wherein the event counter counts up to 999, the device can still be used as a medical compliance device to allow the doctor to determine how many times the patient has been warned to take medication and in response thereto has silenced the alarm.

Flip-flops 261*e* through 261*h* are similarly set by the circuitry comprising NOR gate 270, NOR gate 271, NOR gate 272 and NAND gate 273 with the exception that the input signals to NOR gate 270 are $\overline{C20}$ and $\overline{C80}$. Flip-flops 281*a* through 281*d* are similarly set by signals developed by NOR gate 276, NOR gate 277, NOR gate 278 and NAND gate 279, wherein the input signals to NOR gate 276 comprise the signal $\overline{C200}$ and $\overline{C800}$.

The structure can be modified so that the alarm starts sounding hourly on the half-hour rather than the hour when the device is used as a medical reminder. This is done by setting the switch to activate the circuit shown in FIG. 10*b* so as to generate a high level input signal to inverter 113 thereby to disable OR gate 115 and enable OR gate 114. The output signal SP is then activated hourly on the half-hour by the $\overline{30}$ signal rather than on the hour mark by the $\overline{00}$ signal.

The structure shown in FIGS. 10*j* and 10*k* allows the time display to be reset as appropriate. Thus, the structure has a fast increment mode and a slow increment mode for time setting. Looking at the structure shown in FIG. 10*j*, AND gate 181 has three inputs, RM2, $\overline{P1}$, $\overline{P2}$. The output signal from AND gate 181 is transmitted to one input lead of NOR gate 183. Likewise, AND gate 182 has one input lead for fast advance time signal (denoted "FFDISPLAY" and derived from flip-flop 174*a* (FIG. 10*h*)), a second input lead labelled 2 Hz which, when the DISPLAY INPUT (set switch 20) is held down, drives at two cycles per second the display to change either hours or minutes shown (depending on whether the select button 19 (FIG. 3*d*) has been pressed once or twice (see FIG. 10*f*) and a third and fourth input lead pair labelled $\overline{P1}$ and $\overline{P2}$. By setting $\overline{P1}$ and $\overline{P2}$ in accordance with the following truth table, the various modes of operation of this circuit shown in FIG. 10*j* and 10*k* can be obtained.

| | $\overline{P1}$ | $\overline{P2}$ |
|---|---|---|
| | 0 | 0 |
| Set hours | 0 | 1 |
| Set minutes | 1 | 0 |
| Reset | 1 | 1 |

P1 and P2 are set by pressing SELECT switch 19 (see FIGS. 3*d* and 10*f*).

If the user wishes to change the count displayed so as to zero out the event counter, the user presses the set button 20 and holds the set button for a selected time, typically two seconds (see FIG. 10*h* which shows flip-flops 174*b* and 174*c* driven by a 1 hertz signal thereby to generate a reset signal $\overline{TRCNT}$ after two seconds). Then while holding the set button 20 down, the user hits the select button 19 which then zeros out the event counter by generating $\overline{P2}$ and $\overline{P1}$. These signals are input to NAND gate 178 (FIG. 10*h*), which allows the $\overline{TRCNT}$ to generate RCN which resets the event counters. Signal RCN from the structure shown in FIG. 10*m* is transmitted to the appropriate input lead labelled RCN to NOR gates 267, 271 and 277 shown in FIG. 10*q* to reset the event counter.

To set hours, the user presses the select button 19 (FIG. 10*f*) a short pulse but does not hold down the select button. This allows the hours then to blink, at which time the user presses the set button 20 (FIG. 10*h*) allowing the hours to increment. To set minutes, the user pulses the select button twice and then presses the set button 20 to allow the minutes to increment. The reset function merely resets the event counter. The hours and minutes are never reset, only incremented.

FIG. 10*k* illustrates the minute setting circuit which operates in an identical manner to the hour setting circuit (FIG. 10*j*).

Additional circuits such as 10*v* and 10*w* are well known circuits used to double the supply voltage $V_{EE}$ to a level sufficient to drive the display (preferably LCD). When the supply voltage is 1.5 volts, the display voltage will be 3 volts. These voltage doubling circuits are of well-known design and use the well-known charge pumping technique to double the voltage and thus will not be described in detail.

Figure 10T:
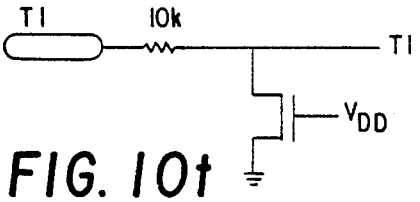
Figure 10U:
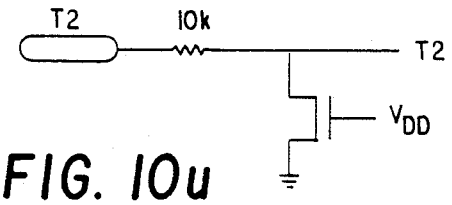
Figure 10V:
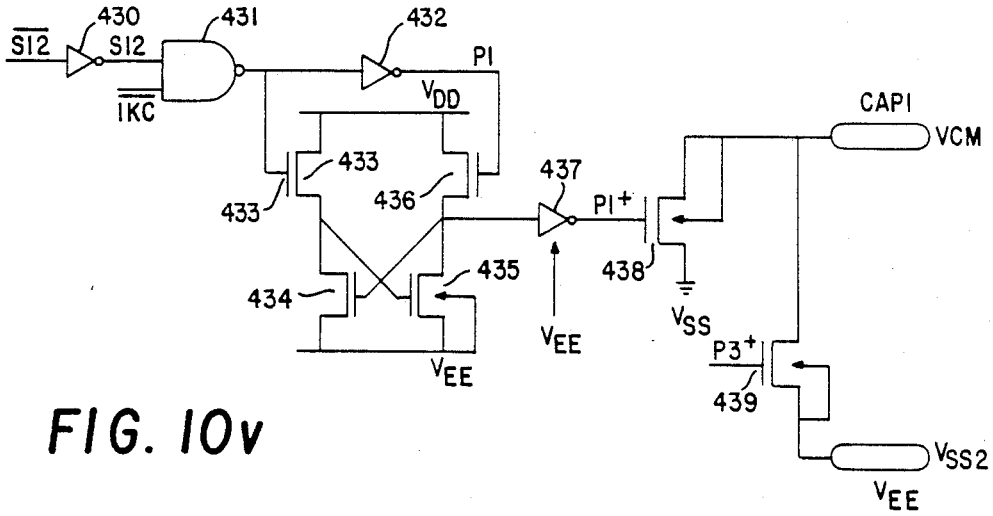
Figure 10W:
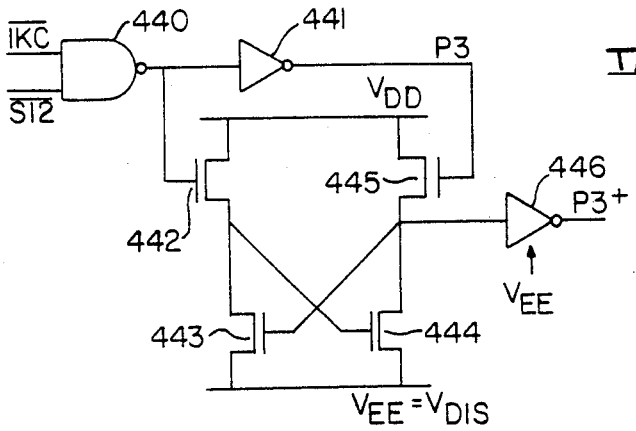
Figure 10X:
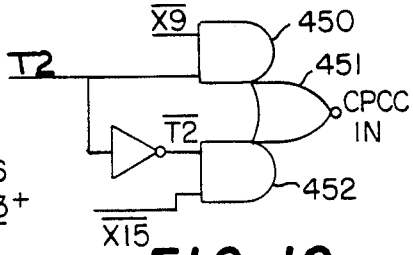
Figure 10Y:
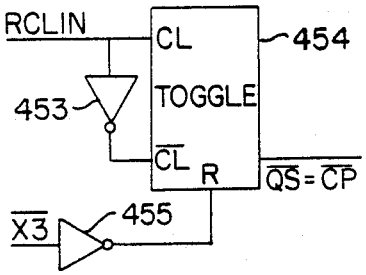
Figure 10Z:
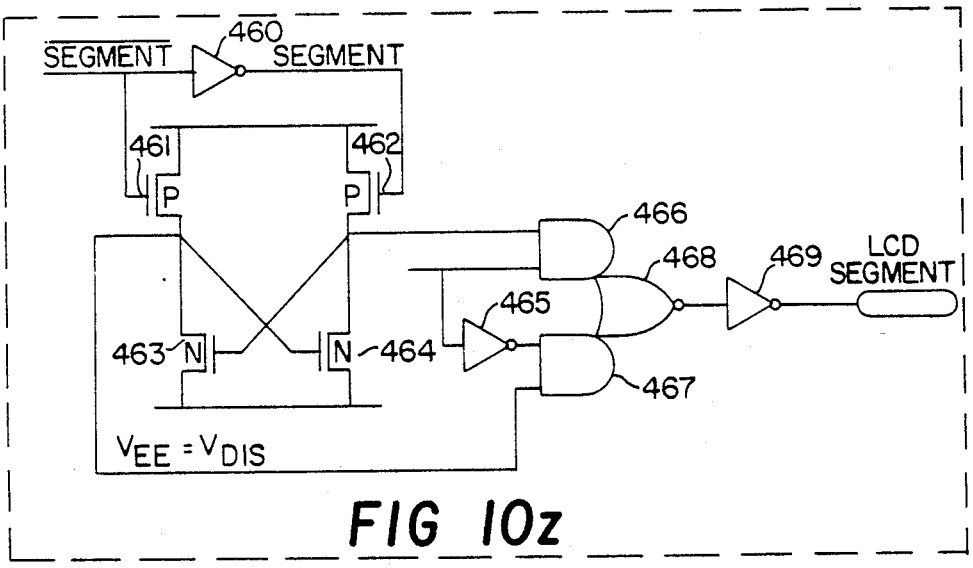
Figure 10A:
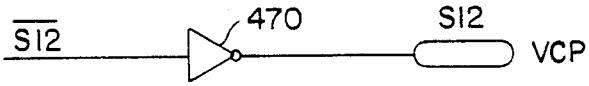
Figure 10B:
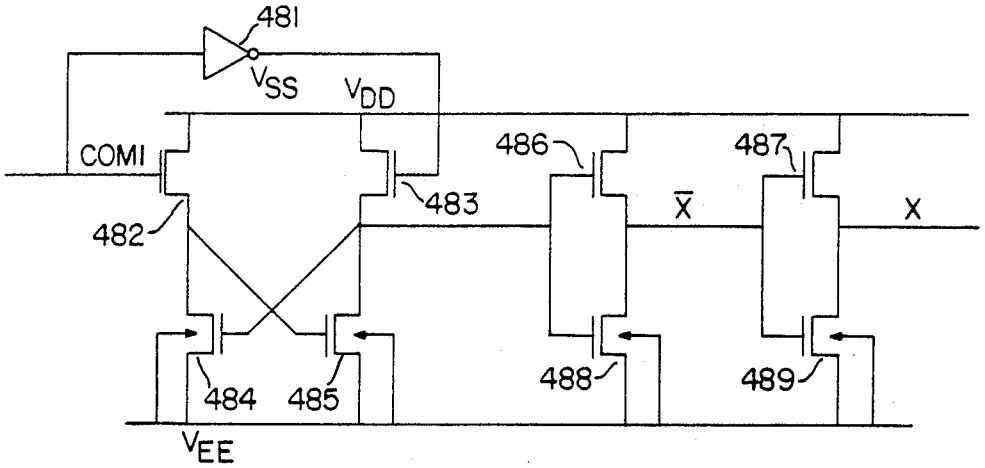
Figure 10C:
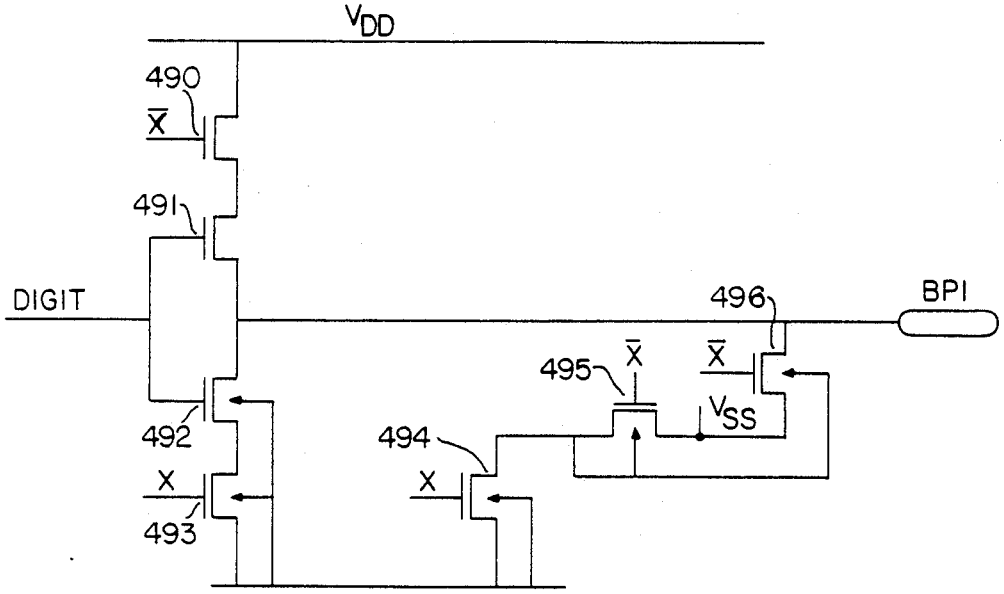
Figure 10D:
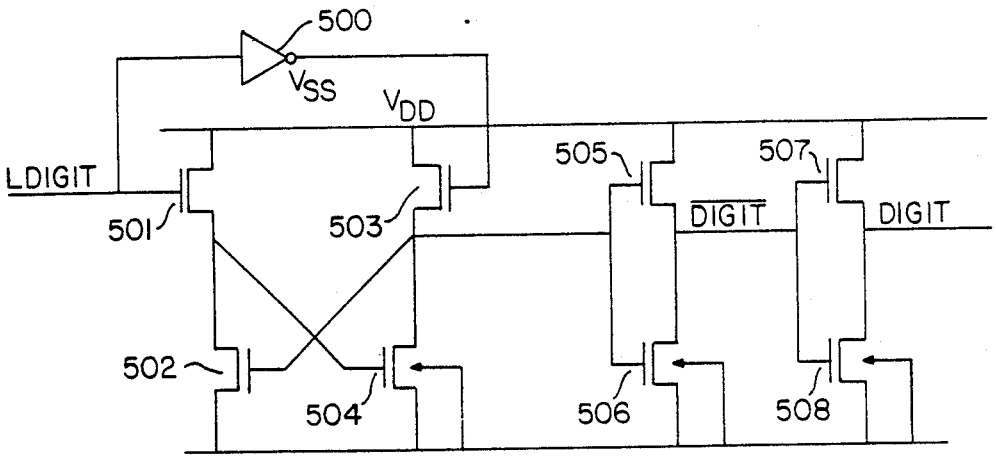
Figure 10E:
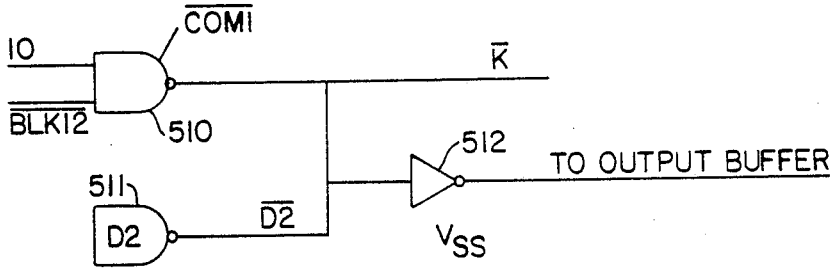
Figure 10F:
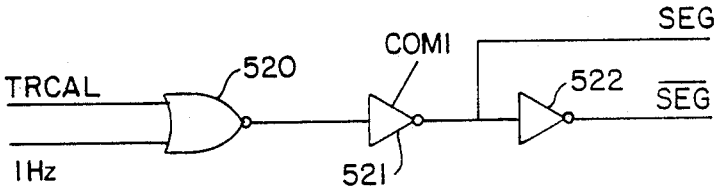

FIG. 10*z* illustrates the circuit used to drive each LCD segment of the display. This circuit again is of well-known design and thus will not be described in detail. FIG. 10*x* illustrates a test circuit driven by inputs T2 (derived from test input circuit FIG. 10*u*). Other circuits are driven by input T1. Note that FIG. 10*t* illustrates another test circuit input producing the output signal T1. These two signals (T1 and T2) are used throughout the circuit to bypass certain counting chains to allow the circuits used in this invention to be easily tested.

FIG. 10*y* generates a pulse from a square wave thereby to provide pulse CT for use at various points throughout the circuitry as a driving clock pulse.

FIGS. 10*ba* and 10*ca* provide certain output signals for use in driving the back planes of the displays. In driving liquid crystal biplex displays, two common signals are employed wherein the phase of one signal goes up and down in alternation to the phase of the other signal. These signals are then used in a well-known manner to drive the displays.

FIG. 10*da* generates a high level output signal for use in driving the circuit of FIG. 10*z* which drives an LCD segment.

FIG. 10*ea* generates a signal for use in driving a display; FIG. 10*fa* generates a flashing signal for providing a flashing colon on the time display and also can be used to transfer a calendar setting, a common watch function not incorporated in the display of the structure of this invention. The output signal from FIG. 10*fa* drives the colon at one cycle per second.

FIGS. 3*a* to 3*d* illustrate the combination of the medicine or pill container 90 with the electronic structure 70 illustrated in FIG. 7. The container 90 is divided into four compartments, 90*a*, 90*b*, 90*c*, and 90*d*. Compartment 90*c* is illustrated opened with pills emerging from the compartment. The letters "A", "B", "C" and "D" on the compartments 90*a* through 90*d*, respectively, correspond to the letters A, B, C and D shown on the recording indicia (typically non-conductive paper or any other non-conductive material upon which alphanumeric symbols can be written) shown in FIGS. 3*b* and 3*c*. FIG. 3*c* shows the arrangement of the recording paper suitable for use in the embodiment of this invention with the pill dispenser shown in FIG. 3*a*. Circles 45-1 through 45-N represent areas of the paper through which holes can be made at the location corresponding to the switches 30-1 through 30-N shown in FIG. 3*c*. However, selected ones of these circles have been removed to provide holes 45-3, 45-6 and 45-11 and 45-N through the paper. These holes are indicated by the darker circles shown in the drawings. Through these holes protrude conductive switches 30-3, 30-6, 30-1 and 30-N so as to make contact with the conductive bar 91*a* mounted in the inside top surface of transparent cover 91. Conductive bar 91*a* contacts each of conductive springs 30-3, 30-6, 30-11 and 30-N to ground these conductive springs and therefore to set the alarm corresponding to the preselected times represented on a one-for-one basis by each of these four springs 30-3, 30-6, 30-11 and 30-N. The times represented by these springs are denoted by the numbers in row 46-0 (FIG. 3B) adjacent the holes formed in paper 46. Thus, row 46-0 shows the times incremented from 6 a.m. through 12 a.m. at which an individual on prescriptions can select to take medicines.

Illustrated in FIG. 3*b* is the way in which the paper or other writing medium can be used to record the dosage of the medicines in each of the compartments A through D. Thus, the paper in FIG. 3*b* illustrates that at 8 a.m., the user of the structure is to take one unit of medicine in compartment A, one unit of medicine in compartment B and one unit of medicine in compartment D. The alarm will sound at 8 a.m. to notify the user that it is time for the medicine. The user will then look at the clock, see the time and go to the appropriate column and rows to determine the proper medicine. The user then will open the compartment containing the corresponding letter on its cover and take the prescribed quantity of medicine from the compartment. The user will also press the silence button 21 (77) (FIG. 3*d* and FIG. 3*c*) to silence the alarm. The pressing of this button simultaneously with the operation of the alarm will result in the event counter (counter 79, FIG. 7) incrementing by one unit.

At 11 a.m., the alarm will again sound and the entries on paper 46 indicate that one unit of the medicine in compartment B and two units of the medicine in compartment C must be taken. At 4 p.m., the alarm will again sound and paper 46 indicates that one unit of the medicine in compartment A and one unit of the medicine in compartment B must be taken. At 8 p.m., the alarm will sound the last time for the day indicating that one unit of the medicine in compartment A and one unit of the medicine in compartment C must be taken.

Naturally, this invention is sufficiently flexible to be used with other quantities of medicines or with medicines that must be taken with greater or lesser frequency than as described. Plainly, the container 90 can be constructed to possess a different number of compartments than shown and the indicia 46 (FIG. 3*b*) can be configured to have a number of rows corresponding to the number of compartments in container 90.

FIG. 3*d* shows the compact structure of this invention used for a medicine reminder and counter in the hand of the user. FIG. 3*d* illustrates one advantage of this invention—the combination of electronic timing and reminder circuits together with the permanent written record of medicine required to be taken and a compact medicine dispenser, all capable of being held in the hand and carried in the pocket or pocketbook of the user.

FIG. 4 illustrates the structure of this invention suitable for use with an appointment calendar. As shown in FIG. 4, the switches 48-1 through 48-N are arranged on the left-hand side of the structure such that each switch 48-1 through 48-N is adjacent a line corresponding to a time in the appointment calendar. The circuitry has been configured by a hard wire change in the structure of FIG. 7 to increment on a half-hour basis rather than an hourly basis. Switches 48-4, 48-12, 48-n and 48-N have been moved to the right to activate the alarm which is hard wired to go off at the times corresponding to these switches set in the appointment calendar 49 mounted in the structure. As described above in conjunction with FIGS. 10*a*, 10*b* and 10*c*, the alarm times are set to follow a half-hour increment. Thus, alarms will sound at those half-hours switched on by switches 48-4, 48-12, 48-n and 48-N from 8 a.m. to 5:30 p.m. Note that the 5:30 p.m. alarm can be used to remind a person of events later in the evening if necessary. The alarm is silenced by pressing button 77 and the time can be set by appropriate use as described above of select and set buttons 19 and 20.

Note that this appointment calendar provides the advantages of an electronic alarm together with a permanent written record of the events which occurred on a given day. The bottom of each page in the appointment calendar inserted in the structure in combination with the electronic alarm system is appropriately dated for this purpose. Thus a permanent record can be retained by the user of his or her activities on each day while at the same time the user can enjoy the convenience of the electronic timer and reminder system.

The paper 46 shown in FIG. 3*b* and paper 25 shown in FIG. 6*d* must be such that the springs are not able to punch through the paper in areas where it is not desired for contact to be made between the underlying springs and the overlying conducting bar. The writing medium must also be non-conductive.

The invention has been described in conjunction with the description of several embodiments. These embodiments are meant to be illustrative only and not limiting and other embodiments of the invention will be apparent to those skilled in the art in view of the above disclosure. While the medical alarm system of this invention is described as capable of being activated at hourly increments on the hour or on each half hour, this medical alarm system can, if desired, be adjusted to operate at hourly increments referenced to any other time merely by advancing or setting back the time. In addition, systems can be built in accordance with this invention capable of being incremented in other than hourly increments. Also, while an audible display is contemplated for use with the structure of this invention, a visual display, such as a light, can be used alone or in combination with an audible display, if desired. Of course, if desired, the alarm times can be hardwired in accordance with the needs of a particular patient to prevent the patient from inadvertently shutting off an alarm.

I claim:

1. A structure for assisting in keeping track of the times at which events are to occur which comprises:

means for generating signals representing up to N different times at which specified events are to occur, where N is a selected positive integer;

means for setting selected times at which certain events are to occur, said means for setting said selected times comprising switch means for indicating that a selected number n of said N times are times at which selected events should occur, where n is an integer given by $1<n<N$;

alarm means for indicating the occurrence of each of said n times at which selected events should occur; and means for silencing said alarm means once said alarm means indicate the occurrence of one of said n times, said means for silencing being operative only while said alarm means indicates the occurrence of one of said n times, thereby to prevent the accidental silencing of said alarm means before or between the occurrence of each of said n times.

2. Structure as in claim 1 wherein said alarm means for indicating any one of up to N selected times comprises:

a plurality of N conductive switch means corresponding on a one-to-one basis to said N different times; and means for disabling selected ones of said switch means, thereby to prevent said alarm means from sounding at the times corresponding to said selected ones of said switch means.

3. Structure as in claim 1 including means for displaying the time of day.

4. Structure as in claim 1 wherein said switch means comprises a plurality of N switches, corresponding on a one-to-one basis to said N times, each switch being suitable for setting said alarm means to indicate the occurrence of the corresponding time.

5. Structure as in claim 4 including means for recording the events which are to occur at selected times, said means for recording said events being located in said structure adjacent said plurality of N switches so that the events which are to occur at a given time are described on said means for recording adjacent said switch corresponding to the time at which the events should occur.

6. Structure as in claim 5 wherein said structure includes means for disabling said alarm means in response to said means for recording indicating that no events are to occur or in response to said means for recording indicating that all switch means are set to indicate events, thereby to prevent said structure from operating in an erroneous mode.

7. Structure as in claim 1 in combination with container means for containing medication to be taken at the selected times indicated by said means for setting selected times at which certain events are to occur.

8. Structure as in claim 7 including means for indicating which particular medicament is to be taken at each of said selected times, the means for indicating providing a means for selecting up to K different medicaments to be taken at any one selected time; and wherein said container comprises up to K different compartments thereby to provide means for storing up to K different medicaments separately in said up to K separate compartments in said container, wherein K is a positive integer representing the maximum number of compartments in said container.

9. Structure as in claim 7 including means for counting the number of times said alarm means indicates the occurrence of one of said n times while said means for silencing said alarm means is simultaneously pressed thereby to provide a cumulative count of the total number of times the user of said structure has been warned to take a medication.

10. Structure as in claim 9 including means for recording said cumulative count.

11. Structure as in claim 1 including in combination therewith means for indicating the events which are to take place at each of said selected times, thereby to provide a permanent record of said events, said means for indicating being adjacent to said switch means such that the particular switch means set to operate alarm means have adjacent to them the particular events which are to occur at the times corresponding to those switch means.

12. Structure as in claim 11 including means for preventing said alarm from being activated in the absence of said means for indicating being placed in said structure thereby to prevent incorrect operation of the alarm.

13. Structure as in claim 3 including means for setting the time displayed by said means for displaying.

14. Structure as in claim 10 including means for resetting to zero the number of events displayed by said means for recording said cumulative count.

15. Structure as in claim 9 wherein said cumulative count is automatically reset at zero at a selected time each day.

16. Structure as in claim 9 wherein said cumulative count is set to zero whenever said cumulative count reaches a selected number.

* * * * *

UNITED STATES PATENT AND TRADEMARK OFFICE

CERTIFICATE OF CORRECTION

PATENT NO. : 4,490,711

DATED : December 25, 1984

INVENTOR(S) : Robert W. Johnston

It is certified that error appears in the above—identified patent and that said Letters Patent is hereby corrected as shown below:

ABSTRACT

Line 1, delete "ir" and insert --is--.

SPECIFICATION

Col. 9, line 13, delete the arrow above the word "embodiment";

Col. 10, line 9, delete the line above the word "ALMOUT";

Col. 10, line 20, delete "BRES.X4" and insert --BRES.$\overline{X4}$--;

Col. 12, line 7, delete "INPUT" and insert --input--;

Col. 13, line 5, delete "CT" and insert --$\overline{CT}$--;

CLAIMS

Claim 1, line 9, delete "n" and insert --n--;

Claim 1, line 11, delete "n is" and insert --n is--;

Claim 1, line 11, delete "$1<n<N$" and insert --$1 \leq n \leq N$--;

UNITED STATES PATENT AND TRADEMARK OFFICE

CERTIFICATE OF CORRECTION

PATENT NO. : 4,490,711

DATED : December 25, 1984

INVENTOR(S) : Robert W. Johnston

It is certified that error appears in the above—identified patent and that said Letters Patent is hereby corrected as shown below:

Claim 1, line 13, delete "n" and insert --n--;

Claim 1, line 16, delete "n" and insert --n--;

Claim 1, line 19, delete "n" and insert --n--;

Claim 1, line 21, delete "n" and insert --n--.

Signed and Sealed this

*Tenth* Day of *September 1985*

[SEAL]

*Attest:*

DONALD J. QUIGG

*Attesting Officer* *Acting Commissioner of Patents and Trademarks - Designate*